US011542768B2

(12) United States Patent
Ross et al.

(10) Patent No.: US 11,542,768 B2
(45) Date of Patent: Jan. 3, 2023

(54) METHOD TO MANIPULATE A WELL USING AN OVERBALANCED PRESSURE CONTAINER

(71) Applicant: METROL TECHNOLOGY LIMITED, Aberdeen (GB)

(72) Inventors: Shaun Compton Ross, Aberdeen (GB); Leslie David Jarvis, Stonehaven (GB)

(73) Assignee: METROL TECHNOLOGY LIMITED, Aberdeen (GB)

( * ) Notice: Subject to any disclaimer, the term of this patent is extended or adjusted under 35 U.S.C. 154(b) by 312 days.

(21) Appl. No.: 16/302,646

(22) PCT Filed: May 26, 2017

(86) PCT No.: PCT/GB2017/051516
§ 371 (c)(1),
(2) Date: Nov. 18, 2018

(87) PCT Pub. No.: WO2017/203286
PCT Pub. Date: Nov. 30, 2017

(65) Prior Publication Data

US 2019/0292866 A1 Sep. 26, 2019

(30) Foreign Application Priority Data

May 26, 2016 (GB) ..... 1609285

(51) Int. Cl.
*E21B 27/02* (2006.01)
*E21B 34/16* (2006.01)
(Continued)

(52) U.S. Cl.
CPC ..... *E21B 27/02* (2013.01); *E21B 34/16* (2013.01); *E21B 43/255* (2013.01); *E21B 47/06* (2013.01);
(Continued)

(58) Field of Classification Search
CPC ..... E21B 27/02
See application file for complete search history.

(56) References Cited

U.S. PATENT DOCUMENTS 2,619,180 A 11/1952 Smith et al.
3,020,961 A 2/1962 Orr
(Continued)

FOREIGN PATENT DOCUMENTS

CN 102505939 6/2012
CN 203531888 4/2014
(Continued)

OTHER PUBLICATIONS

Examination Report for Corresponding Eurasian Application No. 201892725, dated Apr. 15, 2020.
(Continued)

*Primary Examiner* — Michael R Wills, III
*Assistant Examiner* — Neel Girish Patel
(74) *Attorney, Agent, or Firm* — Womble Bond Dickinson (US) LLP

(57) ABSTRACT

A method to manipulate a well, comprising running an apparatus (60*a*) having a container (68*a*) with a volume of gas at a higher pressure than a surrounding portion of the well. The well is isolated, and a wireless control signal, such as an electromagnetic or acoustic signal, is sent to operate a valve assembly (62*a*) to selectively allow or resist fluid exit from a portion of the container (68*a*), via a port (61*a*). Some of the pressurised gas may itself be expelled in to the surrounding portion of the well, or it may be used to drive a fluid out of the container, such as an acid.

25 Claims, 8 Drawing Sheets

(51) Int. Cl.

| | |
|---|---|
| ***E21B 47/06*** | (2012.01) |
| ***E21B 43/25*** | (2006.01) |
| ***E21B 47/117*** | (2012.01) |
| ***E21B 33/12*** | (2006.01) |
| ***E21B 43/26*** | (2006.01) |
| ***E21B 47/18*** | (2012.01) |
| ***E21B 47/07*** | (2012.01) |
| ***E21B 47/13*** | (2012.01) |

(52) U.S. Cl.

CPC ..... *E21B 47/117* (2020.05); *E21B 33/12* (2013.01); *E21B 43/26* (2013.01); *E21B 47/07* (2020.05); *E21B 47/13* (2020.05); *E21B 47/18* (2013.01)

(56) References Cited

U.S. PATENT DOCUMENTS 5,394,141 A 2/1995 Soulier
5,576,703 A 11/1996 MacLeod et al.
6,173,772 B1 1/2001 Vaynshteyn
6,357,525 B1 3/2002 Langseth et al.
6,494,616 B1 12/2002 Tokhtuev et al.
8,215,164 B1 7/2012 Hussain et al.
2002/0020535 A1* 2/2002 Johnson ..... E21B 49/08 166/363
2002/0066563 A1* 6/2002 Langseth ..... E21B 49/081 166/264
2003/0042016 A1 3/2003 Vinegar
2003/0056952 A1 3/2003 Stegemeier et al.
2004/0099418 A1* 5/2004 Behrmann ..... E21B 21/00 166/312
2004/0104029 A1 6/2004 Martin
2005/0077086 A1* 4/2005 Vise ..... E21B 47/06 175/59
2005/0194134 A1* 9/2005 McGregor ..... E21B 49/06 166/264
2006/0225881 A1 10/2006 O'Shaughnessy et al.
2007/0162235 A1* 7/2007 Zhan ..... G01V 1/40 702/6
2007/0236215 A1 10/2007 Innes et al.
2008/0066536 A1 3/2008 Goodwin et al.
2008/0156482 A1 7/2008 Gubar et al.
2009/0229813 A1 9/2009 Brink et al.
2010/0044044 A1* 2/2010 Johnson ..... F42B 3/02 166/297
2010/0095758 A1* 4/2010 Georgi ..... E21B 49/084 73/152.28
2010/0155054 A1* 6/2010 Innes ..... E21B 27/02 166/165
2010/0242586 A1* 9/2010 Elshahawi ..... E21B 33/1243 73/152.39
2011/0158050 A1 6/2011 Merino et al.
2011/0174487 A1 7/2011 Burleson et al.
2011/0198077 A1* 8/2011 Kischkat ..... E21B 49/10 166/250.01
2011/0303409 A1 12/2011 Harrigan et al.
2012/0085540 A1* 4/2012 Heijnen ..... E21B 27/02 166/305.1
2013/0068463 A1* 3/2013 Landsiedel ..... E21B 33/1243 166/311
2013/0075109 A1 3/2013 Frisby et al.
2013/0133883 A1 5/2013 Hill
2013/0299165 A1 11/2013 Crow
2014/0041873 A1 2/2014 Lovik
2014/0311736 A1 10/2014 Pipchuk et al.
2014/0345103 A1* 11/2014 Osaland ..... E21B 37/02 29/426.3
2015/0159480 A1 6/2015 Kalyanaraman et al.
2015/0159484 A1* 6/2015 Dumont ..... G01V 9/00 166/250.02
2015/0167442 A1* 6/2015 Harfoushian ..... E21B 49/082 166/264
2015/0233773 A1 8/2015 Sale et al.
2015/0292288 A1 10/2015 Kasperski et al.
2015/0315895 A1 11/2015 Patel et al.
2015/0337629 A1* 11/2015 Zhang ..... E21B 43/25 166/255.1
2015/0377019 A1* 12/2015 Gleitman ..... E21B 49/006 166/250.01
2016/0024899 A1* 1/2016 Lynn ..... E21B 43/255 166/305.1
2016/0123133 A1 5/2016 Leeflang et al.
2016/0153272 A1* 6/2016 Mace ..... F42D 3/00 166/299
2016/0168985 A1* 6/2016 Betancourt-Pocaterra ..... E21B 49/005 73/152.04
2016/0265312 A1* 9/2016 Holly ..... G05D 7/0676
2016/0376877 A1* 12/2016 LaGrange ..... E21B 43/116 175/4.6
2017/0022809 A1* 1/2017 Garcia ..... E21B 49/088
2017/0254198 A1* 9/2017 Dybdahl ..... G01N 1/2035
2017/0328155 A1* 11/2017 Richards ..... E21B 34/08

FOREIGN PATENT DOCUMENTS

| | | |
|---|---|---|
| DE | 102010014415 | 12/2010 |
| EP | 2192262 | 6/2010 |
| EP | 2886790 | 6/2015 |
| GB | 2522272 | 7/2015 |
| WO | 200301169 | 1/2003 |
| WO | 2003098176 | 11/2003 |
| WO | 2014022384 | 2/2014 |
| WO | 2014120988 | 8/2014 |
| WO | 2017203285 | 11/2017 |
| WO | 2017203287 | 11/2017 |
| WO | 2017203288 | 11/2017 |
| WO | 2017203290 | 11/2017 |
| WO | 2017203291 | 11/2017 |
| WO | 2017203292 | 11/2017 |
| WO | 2017203293 | 11/2017 |
| WO | 2017203294 | 11/2017 |
| WO | 2017203295 | 11/2017 |
| WO | 2017203296 | 11/2017 |

OTHER PUBLICATIONS

International Search Report for PCT/GB2017/051516, dated Jul. 25, 2017.
Schlumberger: "WellWatcher Flux, Multizonal reservoir monitoring system", 2016.
Copending International Application No. PCT/GB2017/051515 filed May 26, 2017.
Copending International Application No. PCT/GB2017/051517 filed May 26, 2017.
Copending International Application No. PCT/GB2017/051518 filed May 26, 2017.
Copending International Application No. PCT/GB2017/051520 filed May 26, 2017.
Copending International Application No. PCT/GB2017/051521 filed May 26, 2017.
Copending International Application No. PCT/GB2017/051522 filed May 26, 2017.
Copending International Application No. PCT/GB2017/051523 filed May 26, 2017.
Copending International Application No. PCT/GB2017/051524 filed May 26, 2017.
Copending International Application No. PCT/GB2017/051525 filed May 26, 2017.
Copending International Application No. PCT/GB2017/051526 filed May 26, 2017.
International Preliminary Report on Patentability for PCT/GB2017/051516, dated May 3, 2018.
Examination Report for Corresponding Eurasian Application No. 201892725, dated Nov. 20, 2020.

(56) References Cited

OTHER PUBLICATIONS

Examination and Search Report for Corresponding Malaysian Application No. PI 2018002074, dated Dec. 25, 2021.

* cited by examiner

METHOD TO MANIPULATE A WELL USING AN OVERBALANCED PRESSURE CONTAINER

CROSS REFERENCE TO RELATED APPLICATIONS

This application is a 35 U.S.C. 371 National Stage of International Application No. PCT/GB2017/051516, titled "METHOD TO MANIPULATE A WELL USING AN OVERBALANCED PRESSURE CONTAINER", filed May 26, 2017, which claims priority to GB Application No. 1609285.0, titled "METHOD TO MANIPULATE A WELL", filed May 26, 2016, all of which are incorporated by reference herein in their entirety.

This invention relates to a method to manipulate a well.

Wells or boreholes are commonly drilled for a variety of reasons in the oil and gas industry, not least to function as wells to recover hydrocarbons, but also as test wells, observation wells or injection wells.

On occasion, it may be necessary to deploy fluid into the well. For example, an acid treatment may be conducted where a chemical, often hydrochloric acid based, is deployed in a well in order to remove or mitigate blockages or potential blockages, such as scale, in the well. This can also be used to treat perforations in the well.

In order to deploy the acid treatment, fluid may be pumped from surface through the tubing. However this may not accurately direct the fluid to the specific area of the well or formation required.

In order to more accurately deploy fluid into a required area of the well, coiled tubing may be used. A 2" diameter coiled tube, for example, can be deployed into the well. The acid treatment is then pumped down the tube and exits into the well at the appropriate area.

Whilst generally satisfactory, the inventors of the present invention have noted that deploying fluids in such a manner can be capital intensive requiring considerable rig time and large volumes of fluid. When using coiled tubing, many thousands of feet is often required (depending on the well depth). Moreover it is a time-consuming process to launch the coiled tubing, deploy the fluid, and then recover the coiled tubing. Sometimes coiled tubing cannot access parts of the well due to the configuration of the bottom hole assembly, and may not be able to deploy the fluid to the particular area intended.

A number of other fluids may be deployed in a well, such as a breaker fluid.

Hydraulic fracturing or various pressure tests, such as an interval injectivity test and a permeability test, can also be carried out using pressure applied from surface. However certain portions of the well may be isolated from the surface, or it may not be possible to isolate certain portions of the well from other portions, whilst maintaining pressure connection to the surface.

The inventors of the present invention have sought to mitigate one or more of the problems of the prior art.

According to a first aspect of the present invention, there is provided a method to manipulate a well, comprising:

(a) providing an apparatus comprising:

- a container having a volume of at least 1 litre and at most 1600 litres;
- a port to allow pressure and fluid communication between a portion of the container and the surrounding portion of the well;

- a mechanical valve assembly having a valve member adapted to move, to selectively allow or resist, directly or indirectly, fluid exit from at least a portion of the container, via the port;
- a control mechanism to control the mechanical valve assembly, comprising a communication device configured to receive a control signal for moving the valve member;

(b) providing a fluid comprising a gas in at least a portion of the container, said portion having a volume of at least 1 litre;

(c) pressurising the gas to a pressure of at least 1000 psi and maintaining it at said pressure for at least one minute;

(d) running the apparatus into the well, such that the apparatus is at least 100 m below the surface of the well; then, (e) isolating the port of the apparatus from the surface of the well;

(f) sending a control signal to the communication device at least in part by a wireless control signal transmitted in at least one of the following forms: electromagnetic (EM), acoustic, inductively coupled tubulars and coded pressure pulsing; then, (g) moving the valve member in response to said control signal to allow at least a portion of the fluid to be released from the container;

and wherein, (h) the portion of the container with said gas has a pressure of at least 100 psi more than a surrounding portion of the well immediately before the valve member is moved in response to the control signal.

Thus the combination of control signal and the container according to the invention, provides a method to conveniently manipulate a well in a number of different ways. When the valve member opens to allow fluid exit from the container, after isolating the port of the apparatus from the surface of the well, there may be a pressure surge, which can manipulate the well. This manipulation may be clearing, injecting, fracturing or another process.

In a first embodiment, fluids are delivered to the well or formation. This can include well/reservoir treatment such as acid treatment, and can obviate the need to run coiled tubing.

In another embodiment, various tests can be conducted, such as a pressure test, permeability test and an interval injectivity test.

Some other useful operations in accordance with the present invention are detailed further below.

The pressure of the gas can facilitate said release of fluid from the container.

Step (b) (providing a gas, for example nitrogen) may be performed before step (d) (running the apparatus) and so the apparatus is run into the well with the container having said gas. Likewise, step (c) (pressurising the gas) may also be performed before (d) (running the apparatus).

Therefore step (b) is often performed above, or at the surface of the well or close by (within 20 m). Where a riser connects a well to a platform, step (b) may be performed at the top end of the riser or close by (within 20 m).

Alternatively, the container may be filled with gas when in the well, normally at least 20 m or at least 100 m from the surface of the well, for example, when in position where it would be operated. This may be done for example using coiled tubing, and even pressurised in situ, using pressure applied through well fluid. Thus in certain methods, the procedure may include storing the gas for a time when you do not want or cannot have the coiled tubing in the well. In certain scenarios, coiled tubing may be in the well for a different primary purpose, so it can be used to charge up the container with pressure.

Regardless of the position of the apparatus when pressurising the gas in step (c), the pressure may be obtained from adjacent to or above the apparatus as opposed to well pressure from the reservoir.

In part (c) the pressure is maintained for more than minute (so much longer than a momentary increase in pressure) and may be maintained for at least five minutes and often longer.

In step (b) the fluid may be exclusively a gas, or it may be a mixture of liquid and gas. Said portion of the fluid released in step (g) (which is typically not all of the fluid in the container) may be exclusively a liquid or a gas, or a mixture, but normally comprises a liquid.

The fluid may be a mixture of different substances.

In step (c) the gas may be pressurised to a pressure of at least 1500 psi, optionally at least 2000 psi, at least 3000 psi, or at least 5000 psi.

In step (d), the apparatus may be more than 250 m below the surface of the well, or more than 500 m. For certain embodiments, the apparatus may be deployed in a central bore of a pre-existing tubular in the well, rather than into a pre-existing annulus in the well. An annulus may be defined between the apparatus and a pre-existing tubular in the well.

The well may be isolated from the surface of the well (step (e)) before or after the control signal is sent to the communication device (step (f)).

The entire apparatus, and not just the port of the apparatus, may be isolated from the surface of the well.

Isolating the port of the apparatus from the surface of the well means preventing pressure or fluid communication between the port and the surface of the well.

Isolation can be achieved using the well infrastructure and isolating components. Isolating component comprise packers, plugs such as bridge plugs and/or valves. In contrast, well infrastructure comprises cement in an annulus, casing and/or other tubulars. In certain embodiments, more than one isolating component can isolate the port of the apparatus from the surface of the well. For example, a packer may be provided in an annulus and a valve provided in a central tubing and together they isolate the port of the apparatus from the surface of the well. In such cases the uppermost extent of the well section that contains the port of the apparatus is defined by the uppermost isolating component.

Isolating the port of the apparatus from the surface of the well is isolating the section of the well containing the port downhole, such that the uppermost isolating component in that isolated well section is at least 100 m from the surface of the well, optionally at least 250 m, or at least 500 m.

The port of the apparatus is typically at least 100 m from the uppermost isolating component in the same section of the well. In certain embodiments, the port of the apparatus is at most 500 m from the uppermost isolating component in the same section of the well, optionally at most 200 m therefrom.

The well, or a section of the well, may be shut in downhole before the valve member moves in response to the control signal.

The step of isolating the port of the apparatus from the surface of the well may include shutting in at least a section of the well. For example the well can be shut in above the port of the apparatus, which isolates the port of the apparatus from the surface of the well.

For other embodiments at least a section of the well can be shut in separate to this isolating step, for example, below the apparatus, or the well may have been shut in at an earlier date.

Isolating the port of the apparatus from the surface of the well, and optionally shutting in the well, can reduce the volume exposed to the apparatus which then focuses the released fluid to the intended area.

The isolating components may be upper isolating components, and lower isolating components may be used to isolate a section of the well from a further section therebelow.

Thus embodiments of the present invention allow release of fluids in a lower isolated section of a well where it may not be hitherto possible, convenient or indeed safe to do so using conventional means such as fluid control lines to surface.

The pressure difference between the container and the surrounding area of the well before the valve member is moved to allow fluid exit, may be least 500 psi, sometimes at least 2000 psi or at least 5000 psi.

The well may be a production well.

Annular Sealing Device

The apparatus may be provided in the well below an annular sealing device, the annular sealing device engaging with an inner face of casing or wellbore in the well, and being at least 100 m below a surface of the well.

For certain embodiments, the annular sealing device is one of the isolating components.

A connector is normally also provided connecting the apparatus to the annular sealing device, the connector being above the apparatus and below the annular sealing device.

The control signal may be sent from above the annular sealing device to the apparatus below the annular sealing device.

The annular sealing device may be at least 300 m from the surface of the well. The surface of the well is the top of the uppermost casing of the well. References to 'casing' includes 'liner' unless stated otherwise.

The annular sealing device is a device which seals between two tubulars (or a tubular and the wellbore), such as a packer element or a polished bore and seal assembly.

The packer element may be part of a packer, bridge plug, or liner hanger, especially a packer or bridge plug.

A packer includes a packer element along with a packer upper tubular and a packer lower tubular along with a body on which the packer element is mounted.

The packer can be permanent or temporary. Temporary packers are normally retrievable and are run with a string and so removed with the string. Permanent packers on the other hand, are normally designed to be left in the well (though they could be removed at a later time).

The annular sealing device may be wirelessly controlled.

A sealing portion of the annular sealing device may be elastomeric, non-elastomeric and/or metallic.

It can be difficult to control the pressure in the area below an annular sealing device between a casing/wellbore and an inner production tubing or test string, especially independent of the fluid column in the inner production tubing. Thus embodiments of the present invention can provide a degree of pressure control in this area, through the combination of the container and the control signal.

The apparatus may be provided below the annular sealing device (or other barrier) and optionally a pressure test carried out from therebelow, when fluid is released. Thus such embodiments can more effectively test well barriers, such as plugs, from the side of the plug more likely to be exposed to pressure that it should withstand in subsequent use. Current methods are inferior since they test barriers thereabove, which is less realistic of the stresses they are intended to withstand. Below said (first) barrier, there may be a second barrier. For example the first barrier may be a cement barrier i.e. comprise or consist of cement, and the second barrier may comprise a bridge plug, and a positive pressure test may be performed on both barriers.

For certain embodiments, kill fluid may be present inside tubing in the well above the annular sealing device before the apparatus is activated.

Connector

The connector is a mechanical connection (as opposed to a wireless connection) and may comprise, at least in part, a tubular connection for example some lengths of tubing or drill pipe. It may include one or more of perforation guns, gauge carriers, cross-overs, subs and valves. The connector may comprise or consist of a threaded connection. The connector does not consist of only wireline, and normally does not include it.

Normally the connector comprises a means to connect to the annular sealing device, such as a thread or dogs.

The connector may be within the same casing that the annular sealing device is connected to.

The connector may comprise a plug for example in the tubing (which is separate from the annular sealing device which may also comprise a plug).

Sensors

The apparatus and/or the well (above and/or especially below the annular sealing device) may comprise at least one pressure sensor. The pressure sensor may be below the annular sealing device and may or may not form part of the apparatus. It can be coupled (physically or wirelessly) to a wireless transmitter and data can be transmitted from the wireless transmitter to above the annular sealing device or otherwise, towards the surface. Data can be transmitted in at least one of the following forms: electromagnetic, acoustic and inductively coupled tubulars, especially acoustic and/or electromagnetic as described herein above.

Such short range wireless coupling may be facilitated by EM communication in the VLF range.

Optionally the apparatus comprises a volume or level indicator such as an empty/full indicator or a proportional indicator arranged to determine the volume or level of fluid in the container. A means to recover the data from the volume indicator is also normally included. The apparatus may comprise a pressure gauge, arranged to measure internal pressure in the container. The communication device may be configured to send signals from the pressure gauge wirelessly.

Preferably at least temperature and pressure sensors are provided. A variety of sensors may be provided, including acceleration, vibration, torque, movement, motion, radiation, noise, magnetism, corrosion; fluid identification such as hydrate, wax and sand production; and fluid properties such as (but not limited to) density, water cut, for example by capacitance and conductivity, corrosion, pH and viscosity. Furthermore the sensors may be adapted to induce the signal or parameter detected by the incorporation of suitable transmitters and mechanisms. The sensors may also sense the status of other parts of the apparatus or other equipment within the well, for example valve member position or motor rotation.

Following operation of the device, data from the pressure sensor, and optionally other sensors, may be used, at least in part, to determine whether to conduct or how to better optimise a well/reservoir treatment such as an acid treatment, a hydraulic fracturing, minifrac operation and/or a well test.

An array of discrete temperature sensors or a distributed temperature sensor can be provided (for example run in) with the apparatus. Optionally therefore it may be below the annular sealing device. These temperature sensors may be contained in a small diameter (e.g. ¼") tubing line and may be connected to a transmitter or transceiver. If required any number of lines containing further arrays of temperature sensors can be provided. This array of temperature sensors and the combined system may be configured to be spaced out so the array of temperature sensors contained within the tubing line may be aligned across the formation, for example the communication paths; either for example generally parallel to the well, or in a helix shape.

Communication path(s) can be perforations created in the well and surrounding formation by a perforating gun. In some cases, use of a perforating gun to provide communication path(s) is not required. For example the well may be open hole and/or it may include a screen/gravel packs, slotted sleeve or a slotted liner or has previously been perforated. References to communication path(s) herein include all such examples where access to the formation is provided and is not limited to perforations created by perforating guns.

The array of discrete temperature sensors may be part of the apparatus or separate from it.

The temperature sensors may be electronic sensors or may be a fibre optic cable.

Therefore in this situation the additional temperature sensor array could provide data from the communication path interval(s) and indicate if, for example, communication paths are blocked/restricted. The array of temperature sensors in the tubing line can also provide a clear indication of fluid flow, particularly when the apparatus is activated. Thus for example, more information can be gained on the response of the communication paths—an upper area of communication paths may have been opened and another area remain blocked and this can be deduced by the local temperature along the array of the temperature sensors.

Such temperature sensors may also be used before, during and after manipulation and therefore used to check the effectiveness of the manipulation by the apparatus.

Moreover, for certain embodiments, multiple longitudinally spaced containers are activated sequentially, and the array of temperature sensors used to assess the resulting flow from communication paths.

Data may be recovered from the pressure sensor(s), before, during and/or after the valve member is moved in response to the control signal. Recovering data means getting it to the surface.

Data may be recovered from the pressure sensor(s), before, during and/or after a perforating gun has been activated in the well.

The data recovered may be real-time/current data and/or historical data.

Data may be recovered by a variety of methods. For example it may be transmitted wirelessly in real time or at a later time, optionally in response to an instruction to transmit. Or the data may retrieved by a probe run into the well on wireline/coiled tubing or a tractor; the probe can optionally couple with the memory device physically or wirelessly.

Memory

The apparatus especially the sensors, may comprise a memory device which can store data for recovery at a later time. The memory device may also, in certain circumstances, be retrieved and data recovered after retrieval.

The memory device may be configured to store information for at least one minute, optionally at least one hour, more optionally at least one week, preferably at least one month, more preferably at least one year or more than five years.

The memory device may be part of a/the sensor(s). Where separate, the memory device and sensors may be connected together by any suitable means, optionally wirelessly or physically coupled together by a wire. Inductive coupling is also an option.

Short range wireless coupling may be facilitated by EM communication in the VLF range.

Container Options

The apparatus may be elongate in shape. It may be in the form of a pipe. It is normally cylindrical in shape.

Whilst the size of the container can vary, depending on the nature of the well, typically the container may have a volume of at least 50 litres (l), optionally at least 100 l. The container may have a volume of at most 1000 l, normally at most 500 l, optionally at most 200 l.

In step (b), the portion of the container having the fluid comprising a gas may be the entire size of the container or may be at least 25 litres, optionally at least 50 l or at least 100 l. It may be less than 500 l, or less than 250 l or less than 100 l.

Thus the apparatus may comprise a pipe/tubular (or a sub in part of a pipe/tubular) housing the container and other components or indeed the container may be made up of tubulars, such as tubing, drill pipe, liner or casing joined together. The tubulars may comprise joints each with a length of from 3 m to 14 m, generally 8 m to 12 m, and nominal external diameters of from 2⅜" (or 2⅞") to 7".

As well as the mechanical valve assembly, the container may comprise a drain valve. For example this may be provided spaced away from the mechanical valve assembly to allow fluid therein to drain more readily when the apparatus is returning to surface.

The container may comprise some propellant, such as nitro-cellulose based powders. This can assist in driving fluid out of the container.

Secondary Containers

In addition to the container (sometimes referred to below as a 'primary container') there may be one or more secondary containers, optionally each with respective control devices controlling fluid communication between the respective secondary container and the surrounding portion of the well or other portion of the apparatus.

The control devices of the secondary containers may include pumps, mechanical valves and/or latch assemblies.

A piston may be provided in one or more of the secondary containers. It may, for certain embodiments, function as the valve.

Alternatively, a floating piston may be controlled indirectly by the control device such as the valve. In some embodiments, the piston may be directly controlled by the latch assembly. The latch assembly can control the floating piston—it can hold the floating piston in place against action of other forces (e.g. well pressure) and is released in response to an instruction from the control mechanism.

Thus a secondary container can have a mechanical valve assembly (such as those described herein) latch assembly, or a pump, which regulates fluid communication between that secondary container and a surrounding portion of the well. The control device may or may not be provided at a port.

Thus there may be one, two, three or more than three secondary containers. The further control devices for the secondary containers may or may not move in response to a (in part at least) wireless control signal, but may instead respond based on a parameter or time delay. Each control device for the respective secondary container can be independently operable. A common communication device may be used for sending a control signal to a plurality of control devices.

The contents of the containers may or may not be miscible at the outlet. For example one container can have a polymer and a second container a cross linker, when mixed, in use, in the well form a gel or otherwise set/cure. The containers can be configured differently, for example have different volumes or chokes etc.

The containers may have a different internal pressure compared to the pressure of the surrounding portion of the well. If less than a surrounding portion of the well, they are referred to as 'underbalanced' and when more than a surrounding portion of the well they are referred to as 'overbalanced'. They may additionally or alternatively include a pump.

Thus (an) underbalanced, overbalanced, and/or pump controlled secondary container(s) as well as associated secondary port and control device may be provided, the secondary container(s) each preferably having a volume of at least one or at least five litres. The secondary containers may in use have a pressure lower/higher than the surrounding portion of the well normally for at least one minute, before the control device is activated optionally in response to the control signal. Fluids surrounding the secondary container can thus be drawn in (for underbalanced or pump controlled containers), optionally quickly, or fluids expelled (for overbalanced or pump controlled containers).

Thus, a plurality of primary, and/or secondary containers or apparatus may be provided each having different functions, the primary container being overbalanced, one or more secondary containers may be underbalanced and one or more secondary containers may be controlled by a pump.

This can be useful, for example, to partially clear a filter cake using an underbalanced container, before deploying an acid treatment onto the perforations using the overbalanced container. Alternatively, for a short interval manipulation, a skin barrier could be removed from the interval by acid release from the overbalanced container and then the apparatus including the pump can be used to pump fluid into the interval.

Fluid from a first chamber within the container can go into another to mix before being released/expelled.

Well/Reservoir Treatment

For certain embodiments therefore, the container comprises a chemical or other fluid to be delivered, such as an acid.

"Acid" treatments such as "acid wash" or "acid injection" can be conducted. The acid may comprise hydrochloric acid or other acids or chemicals used for such so-called acid treatments. The chemical/treatment fluid could be treatment or delivery of the fluids to the well or the formation, such as scale inhibitor, methanol/glycol; or delivering gelling or cutting agents e.g. bromine trifluoride, breaker fluid or a chemical or acid treatment.

Acid wash normally treats the face of the wellbore, or may treat scale within a wellbore. Acids may be directed towards the specific communication paths that are damaged, for example by using openings in a tube.

A conventional acid set-up and treatment conducted from surface is a time-consuming and therefore expensive process. Instead of a conventional acid treatment the method according to the invention may be performed to try to mitigate debris. 'Debris' may include perforation debris and/or formation damage such as filter cake.

Chemical barriers may also be deployed, or precursors to a chemical barrier e.g. cement type material. As an alternative to cement, a solidifying cement substitute such as epoxies and resins, or a non-solidifying cement substitute may be used such as Sandaband™ References herein to cement include such cement substitutes.

An advantage of such embodiments is being able to deploy chemicals in parts of a well in which it may not be possible to deploy, or viably deploy, using conventional means.

Valve Options

The valve member may be adapted to close the port in a first position, and open the port in a second position. Thus normally in a first position the valve member seals the container from the surrounding portion of the well and normally in the second position the valve member allows fluid exit from the container.

In the second position, pressure and fluid communication may be allowed between a portion of the container and the surrounding portion of the well.

The port may comprise a tube with a plurality of openings. The openings, for example at least three, may be spaced apart from each other in the same direction as the well, for example in a direction substantially parallel to the well, or in a spiral shape, the shape having an axis also generally parallel to the well. The tube may be a small diameter tube (e.g. ¼-¾" outer diameter), which may extend over the communication paths. A rotating inner/outer sleeve or other means may be used to selectively open or close the openings.

There may be a plurality of valve members, optionally controlling ports of different sizes and/or at different locations. Each different valve member may be independently controlled or two or more groups of openings may be controlled by separate valves. For example, groups of openings may be provided on a separate tube, each group being controlled by a valve. The method may then direct the fluid to a particular area.

One valve member (for example a smaller one) may be opened, and the pressure change monitored, using information from a pressure gauge inside or outside of the apparatus, the second valve member (for example a larger one) may be opened, for example at an optimum time, and/or to an optimum extent based on information received such as from the pressure gauge.

The fluid when released will often change volumes due to different pressure and temperature in the well. Immediately after being released, it may have a volume in the surrounding portion of the well of at least 1 litre, optionally at least 5 litres, or at least 10 litres of well fluid. Therefore, the fluid released may displace at least 1 litre, optionally at least 5 litres, or at least 10 litres of well fluid.

The apparatus may comprise a choke.

The choke may be integrated with the mechanical valve assembly or it may be in a flowpath comprising the port and the mechanical valve assembly.

The choke area may be less than 100 $mm^2$, normally less than 10 $mm^2$, optionally less than 1 $mm^2$.

For certain embodiments, the size of the cross-sectional area to allow fluid exit may be small enough, for example 0.1-0.25 $cm^2$ to effectively choke the fluid exit.

The valve member may function as a choke. Where a plurality of valve members are provided, multiple different sizes of chokes may be provided. Thus, for certain embodiments, the mechanical valve assembly comprises a variable valve member, which itself can function as a choke and indeed it can be varied in situ (that is, in the well). For example, a choke disk may be used, which may be rotatably mounted with different sizes of apertures to provide a variable choking means.

The valve member may have multiple positions and can move from a closed to an open position, or may have intermediate positions therebetween. More generally, the valve member may move again to the position in which it started, or to a further position, which may be a further open or further closed or partially open/closed position. This is normally in response to a further control signal being received by the communication device (or this may be an instruction in the original signal). Optionally therefore the valve member can move again to resist fluid exit from the container. For example, flow rate can be stopped or started again (optionally before pressure between the container and the well has balanced) or changed, and optionally this may be part-controlled in response to a parameter or time delay.

The mechanical valve assembly comprises the solid valve member. The mechanical valve assembly normally has an inlet, a valve seat and a sealing mechanism. The seat and sealing mechanism may comprise a single component (e.g. pinch valve, or mechanically ruptured disc). Actuation means include spring, pressure (e.g. stored, pumped, well), solenoids, lead screws/gears, and motors.

Suitable mechanical valve assemblies may be selected from the group consisting of: gate valves, ball valves, plug valves, regulating valves, cylindrical valves, piston valves, solenoid valves, diaphragm valves, disc valves, needle valves, pinch valves, spool valves, and sliding or rotating sleeves.

More preferred for the mechanical valve assembly of the present invention is a valve assembly which may be selected from the group consisting of gate valves, ball valves, plug valves, regulating valves, cylindrical valves, piston valves, solenoid valves, disc valves, needle valves, and sliding or rotating sleeves.

In particular, piston, needle and sleeve valve assemblies are especially preferred.

The valve assembly may incorporate a spring mechanism such that in one open position it functions as a variable pressure release valve.

The valve member may be actuated by at least one of a (i) motor & gear, (ii) spring, (iii) pressure differential, (iv) solenoid and (v) lead screw.

The mechanical valve assembly may be at one end of the apparatus. However it may be in its central body. One may be provided at each end.

The control mechanism may be configured to move the valve member in response to the control signal when a certain condition is met, e.g. when a certain pressure is reached or after a time delay. Thus the control signal causing the response of moving the valve member, may be conditional on certain parameters, and different control signals can be sent depending on suitable parameters for the particular well conditions.

The valve member can be controlled directly or indirectly. In certain embodiments, the valve member is driven directly by the control mechanism electro-mechanically or electro-hydraulically via porting. Alternatively, the valve member may be part of a pressure release valve, and is configured to move in response to the control signal when exposed to a pre-determined pressure differential, following activation by a control signal of the control mechanism, such as a control valve opening, which creates the pressure differential.

Floating Piston

The container may have a floating piston separating two sections in the container, referred to as a fluid chamber and a drive chamber, the fluid chamber in communication with the port and the drive chamber on an opposite side of the floating piston, not in communication with the port. Normally the floating piston has a dynamic seal against an inside of the container.

For certain embodiments, the valve member may comprise the floating piston. In such embodiments, the cross-sectional area to allow fluid exit may be different, for example at least 16 $cm^2$, optionally at least 50 $cm^2$ or at least 100 $cm^2$. Normally it is at most 250 $cm^2$ or at most 200 $cm^2$.

In other embodiments, the valve assembly and floating piston are separate devices of the apparatus.

The drive chamber typically comprises pressurised gas in order to drive the floating piston to expel fluids from the fluid chamber on the port side of the floating piston, optionally when a piston control device is activated.

Therefore, the drive chamber is normally the portion of the container that has a pressure of at least 100 psi more than a surrounding portion of the well immediately before the valve member is moved in response to the control signal.

For certain embodiments the floating piston moves when a valve at the port is operated and changes the pressure on either side of the piston.

However for other embodiments, a piston control device may be provided for the floating piston. Oftentimes, this is the mechanical valve assembly provided on the side of the piston not in communication with the port and substantially isolates the drive chamber from said side of piston. Thus when closed it substantially resists pressure acting on the floating piston. Alternatively the piston control device may be a latching mechanism to hold the floating piston in position against the force of the gas in the drive chamber, until it is activated to be released to allow the piston to move.

Thus in response to the control signal, the control mechanism can control the piston control device and the floating piston moves which drives fluids from the fluid chamber to the surrounding portion of the well.

An advantage of such embodiments is that it may be easier to design the apparatus around particular space constraints and/or for particular downhole applications.

Short Interval

The annular sealing device may be a first annular sealing device.

The port may be positioned between two portions of the or an annular sealing device (or two annular sealing devices), and the valve member moved in response to the control signal to expose the pressure in the container to the adjacent well/reservoir in order to conduct a short interval procedure.

Often, the portions are two separate annular sealing devices are used and spaced apart to define the short interval. However a single annular sealing device can be used and the port provided between two portions of the same annular sealing device.

Annular sealing devices used with the short interval procedure normally comprise a packer element. The portions of the packer elements may be from inflatable packers especially for openhole.

Therefore, the method described herein may be used to conduct an interval injectivity, permeability, well/reservoir treatment, hydraulic fracturing, minfrac or similar test/procedure which may require pressure to be applied between two annular sealing devices. Sensors optionally record the pressure. In preferred embodiments, the pressure in the container is released gradually over several seconds (such as 5-10 seconds), or longer (such as 2 minutes-6 hours) or even very slow (such as 1-7 days. Choke functionality is therefore particularly useful.

Thus there can be a second annular sealing device below the first (or a further) annular sealing device where at least the port of the apparatus is positioned below the first/further annular sealing device and above the second annular sealing device. The entire apparatus may be positioned above the second annular sealing device. This second annular sealing device may be wirelessly controlled. Thus it may be expandable and/or retractable by wireless signals.

The short interval, e.g. the distance between two annular sealing devices, may be less than 30 m, optionally less than 10 m, optionally less than 5 m or less than 2 m, less than 1 m, or less than 0.5 m. These distances are taken from lowermost point of an upper packer element of the (first) annular sealing device, and the uppermost point of a lower packer element of the second annular sealing device. Thus this can limit the volume and so the apparatus is more effective when the port is exposed to the limited volume.

The apparatus may be part of a string which includes a drill bit. The annular sealing devices may be mounted on said string, and activated to engage with an outer well casing or wellbore.

The short interval procedure is especially useful in an openhole i.e. uncased section of a well.

For certain embodiments, such a test can provide an initial indication on the reservoir response to an injection/hydraulic fracturing operation, and may reduce the requirement to conduct a larger scale injection/hydraulic fracturing operation.

A short interval test (one or more) may be performed whilst doing a traditional test in an upper or lower zone e.g. drill stem test (DST).

The apparatus is suitable for both openhole and perforated sections and can be run with or without a perforation device.

Pump Addition

A pump may be provided to charge or recharge the pressure in the container for example to repeat a procedure.

Electronics

The apparatus may comprise at least one battery optionally a rechargeable battery. The battery may be at least one of a high temperature battery, a lithium battery, a lithium oxyhalide battery, a lithium thionyl chloride battery, a lithium sulphuryl chloride battery, a lithium carbon-monofluoride battery, a lithium manganese dioxide battery, a lithium ion battery, a lithium alloy battery, a sodium battery, and a sodium alloy battery. High temperature batteries are those operable above 85° C. and sometimes above 100° C. The battery system may include a first battery and further reserve batteries which are enabled after an extended time in the well. Reserve batteries may comprise a battery where the electrolyte is retained in a reservoir and is combined with the anode and/or cathode when a voltage or usage threshold on the active battery is reached.

The control mechanism is normally an electronic control mechanism. The communication device is normally an electronic communication device.

The battery and optionally elements of the control electronics may be replaceable without removing tubulars. They may be replaced by, for example, using wireline or coiled tubing. The battery may be situated in a side pocket.

The apparatus, especially the control mechanism, preferably comprises a microprocessor. Electronics in the apparatus, to power various components such as the microprocessor, control and communication systems, and optionally the valve, are preferably low power electronics. Low power electronics can incorporate features such as low voltage microcontrollers, and the use of 'sleep' modes where the majority of the electronic systems are powered off and a low frequency oscillator, such as a 10-100 kHz, for example 32 kHz, oscillator used to maintain system timing and 'wake-up' functions. Synchronised short range wireless (for example EM in the VLF range) communication techniques can be used between different components of the system to minimize the time that individual components need to be kept 'awake', and hence maximise 'sleep' time and power saving.

The low power electronics facilitates long term use of various components of the apparatus. The control mechanism may be configured to be controllable by the control signal up to more than 24 hours after being run into the well, optionally more than 7 days, more than 1 month, or more than 1 year or up to 5 years. It can be configured to remain dormant before and/or after being activated.

Signals

The wireless control signal is transmitted in at least one of the following forms: electromagnetic, acoustic, inductively coupled tubulars and coded pressure pulsing and references herein to "wireless", relate to said forms, unless where stated otherwise.

The signals may be data or command signals which need not be in the same wireless form. Accordingly, the options set out herein for different types of wireless signals are independently applicable to data and command signals. The control signals can control downhole devices including sensors. Data from sensors may be transmitted in response to a control signal. Moreover data acquisition and/or transmission parameters, such as acquisition and/or transmission rate or resolution, may be varied using suitable control signals.

The communication device may comprise a wireless communication device. In alternative embodiments, the communication device is a wired communication device and the wireless signal transmitted in other parts of the well.

Coded Pressure Pulses

Pressure pulses include methods of communicating from/to within the well/borehole, from/to at least one of a further location within the well/borehole, and the surface of the well/borehole, using positive and/or negative pressure changes, and/or flow rate changes of a fluid in a tubular and/or annular space.

Coded pressure pulses are such pressure pulses where a modulation scheme has been used to encode commands and/or data within the pressure or flow rate variations and a transducer is used within the well/borehole to detect and/or generate the variations, and/or an electronic system is used within the well/borehole to encode and/or decode commands and/or the data. Therefore, pressure pulses used with an in-well/borehole electronic interface are herein defined as coded pressure pulses. An advantage of coded pressure pulses, as defined herein, is that they can be sent to electronic interfaces and may provide greater data rate and/or bandwidth than pressure pulses sent to mechanical interfaces.

Where coded pressure pulses are used to transmit control signals, various modulation schemes may be used to encode control signals such as a pressure change or rate of pressure change, on/off keyed (OOK), pulse position modulation (PPM), pulse width modulation (PWM), frequency shift keying (FSK), pressure shift keying (PSK), amplitude shift keying (ASK), combinations of modulation schemes may also be used, for example, OOK-PPM-PWM. Data rates for coded pressure modulation schemes are generally low, typically less than 10 bps, and may be less than 0.1 bps.

Coded pressure pulses can be induced in static or flowing fluids and may be detected by directly or indirectly measuring changes in pressure and/or flow rate. Fluids include liquids, gasses and multiphase fluids, and may be static control fluids, and/or for certain embodiments, fluids being produced from or injected in to the well.

Signals—General

Preferably the wireless signals are such that they are capable of passing through the isolation components or a barrier, such as a plug or said annular sealing device, when fixed in place. Preferably therefore the wireless signals are transmitted in at least one of the following forms: electromagnetic, acoustic, and inductively coupled tubulars.

EM/Acoustic and coded pressure pulsing use the well, borehole or formation as the medium of transmission. The EM/acoustic or pressure signal may be sent from the well, or from the surface. If provided in the well, an EM/acoustic signal can travel through any annular sealing device, although for certain embodiments, it may travel indirectly, for example around any annular sealing device.

Electromagnetic and acoustic signals are especially preferred—they can transmit through/past an annular sealing device without special inductively coupled tubulars infrastructure, and for data transmission, the amount of information that can be transmitted is normally higher compared to coded pressure pulsing, especially data from the well.

Therefore, the communication device may comprise an acoustic communication device and the wireless control signal comprises an acoustic control signal and/or the communication device may comprise an electromagnetic communication device and the wireless control signal comprises an electromagnetic control signal.

Similarly the transmitters and receivers used correspond with the type of wireless signals used. For example an acoustic transmitter and receiver are used if acoustic signals are used.

Where inductively coupled tubulars are used, there are normally at least ten, usually many more, individual lengths of inductively coupled tubular which are joined together in use, to form a string of inductively coupled tubulars. They have an integral wire and may be formed tubulars such as tubing, drill pipe or casing. At each connection between adjacent lengths there is an inductive coupling. The inductively coupled tubulars that may be used can be provided by N O V under the brand Intellipipe®.

Thus, the EM/acoustic or pressure wireless signals can be conveyed a relatively long distance as wireless signals, sent for at least 200 m, optionally more than 400 m or longer which is a clear benefit over other short range signals. Embodiments including inductively coupled tubulars provide this advantage/effect by the combination of the integral wire and the inductive couplings. The distance travelled may be much longer, depending on the length of the well.

Data and commands within the signal may be relayed or transmitted by other means. Thus the wireless signals could be converted to other types of wireless or wired signals, and optionally relayed, by the same or by other means, such as hydraulic, electrical and fibre optic lines. In one embodiment, the signals may be transmitted through a cable for a first distance, such as over 400 m, and then transmitted via acoustic or EM communications for a smaller distance, such as 200 m. In another embodiment they are transmitted for 500 m using coded pressure pulsing and then 1000 m using a hydraulic line.

Thus whilst non-wireless means may be used to transmit the signal in addition to the wireless means, preferred configurations preferentially use wireless communication. Thus, whilst the distance travelled by the signal is dependent on the depth of the well, often the wireless signal, including relays but not including any non-wireless transmission, travel for more than 1000 m or more than 2000 m. Preferred embodiments also have signals transferred by wireless signals (including relays but not including non-wireless means) at least half the distance from the surface of the well to the apparatus.

Different wireless signals may be used in the same well for communications going from the well towards the surface, and for communications going from the surface into the well.

Thus, the wireless signal may be sent to the communication device, directly or indirectly, for example making use of in-well relays above and/or below any annular sealing device. The wireless signal may be sent from the surface or from a wireline/coiled tubing (or tractor) run probe at any point in the well optionally above any annular sealing device. For certain embodiments, the probe may be positioned relatively close to any annular sealing device for example less than 30 m therefrom, or less than 15 m.

Acoustic

Acoustic signals and communication may include transmission through vibration of the structure of the well including tubulars, casing, liner, drill pipe, drill collars, tubing, coil tubing, sucker rod, downhole tools; transmission via fluid (including through gas), including transmission through fluids in uncased sections of the well, within tubulars, and within annular spaces; transmission through static or flowing fluids; mechanical transmission through wireline, slickline or coiled rod; transmission through the earth; transmission through wellhead equipment. Communication through the structure and/or through the fluid are preferred.

Acoustic transmission may be at sub-sonic (<20 Hz), sonic (20 Hz-20 kHz), and ultrasonic frequencies (20 kHz-2 MHz). Preferably the acoustic transmission is sonic (20 Hz-20 khz).

The acoustic signals and communications may include Frequency Shift Keying (FSK) and/or Phase Shift Keying (PSK) modulation methods, and/or more advanced derivatives of these methods, such as Quadrature Phase Shift Keying (QPSK) or Quadrature Amplitude Modulation (QAM), and preferably incorporating Spread Spectrum Techniques. Typically they are adapted to automatically tune acoustic signalling frequencies and methods to suit well conditions.

The acoustic signals and communications may be unidirectional or bi-directional. Piezoelectric, moving coil transducer or magnetostrictive transducers may be used to send and/or receive the signal.

EM

Electromagnetic (EM) (sometimes referred to as Quasi-Static (QS)) wireless communication is normally in the frequency bands of: (selected based on propagation characteristics)

- sub-ELF (extremely low frequency)<3 Hz (normally above 0.01 Hz);
- ELF 3 Hz to 30 Hz;
- SLF (super low frequency) 30 Hz to 300 Hz;
- ULF (ultra low frequency) 300 Hz to 3 kHz; and,
- VLF (very low frequency) 3 kHz to 30 kHz.

An exception to the above frequencies is EM communication using the pipe as a wave guide, particularly, but not exclusively when the pipe is gas filled, in which case frequencies from 30 kHz to 30 GHz may typically be used dependent on the pipe size, the fluid in the pipe, and the range of communication. The fluid in the pipe is preferably non-conductive. U.S. Pat. No. 5,831,549 describes a telemetry system involving gigahertz transmission in a gas filled tubular waveguide.

Sub-ELF and/or ELF are preferred for communications from a well to the surface (e.g. over a distance of above 100 m). For more local communications, for example less than 10 m, VLF is preferred. The nomenclature used for these ranges is defined by the International Telecommunication Union (ITU).

EM communications may include transmitting data by one or more of the following: imposing a modulated current on an elongate member and using the earth as return; transmitting current in one tubular and providing a return path in a second tubular; use of a second well as part of a current path; near-field or far-field transmission; creating a current loop within a portion of the well metalwork in order to create a potential difference between the metalwork and earth; use of spaced contacts to create an electric dipole transmitter; use of a toroidal transformer to impose current in the well metalwork; use of an insulating sub; a coil antenna to create a modulated time varying magnetic field for local or through formation transmission; transmission within the well casing; use of the elongate member and earth as a coaxial transmission line; use of a tubular as a wave guide; transmission outwith the well casing.

Especially useful is imposing a modulated current on an elongate member and using the earth as return; creating a current loop within a portion of the well metalwork in order to create a potential difference between the metalwork and earth; use of spaced contacts to create an electric dipole transmitter; and use of a toroidal transformer to impose current in the well metalwork.

To control and direct current advantageously, a number of different techniques may be used. For example one or more of: use of an insulating coating or spacers on well tubulars;

selection of well control fluids or cements within or outwith tubulars to electrically conduct with or insulate tubulars; use of a toroid of high magnetic permeability to create inductance and hence an impedance; use of an insulated wire, cable or insulated elongate conductor for part of the transmission path or antenna; use of a tubular as a circular waveguide, using SHF (3 GHz-30 GHz) and UHF (300 MHz to 3 GHz) frequency bands.

Suitable means for receiving the transmitted signal are also provided, these may include detection of a current flow; detection of a potential difference; use of a dipole antenna; use of a coil antenna; use of a toroidal transformer; use of a Hall effect or similar magnetic field detector; use of sections of the well metalwork as part of a dipole antenna.

Where the phrase "elongate member" is used, for the purposes of EM transmission, this could also mean any elongate electrical conductor including: liner; casing; tubing or tubular; coil tubing; sucker rod; wireline; drill pipe; slickline or coiled rod.

A means to communicate signals within a well with electrically conductive casing is disclosed in U.S. Pat. No. 5,394,141 by Soulier and U.S. Pat. No. 5,576,703 by MacLeod et al both of which are incorporated herein by reference in their entirety. A transmitter comprising oscillator and power amplifier is connected to spaced contacts at a first location inside the finite resistivity casing to form an electric dipole due to the potential difference created by the current flowing between the contacts as a primary load for the power amplifier. This potential difference creates an electric field external to the dipole which can be detected by either a second pair of spaced contacts and amplifier at a second location due to resulting current flow in the casing or alternatively at the surface between a wellhead and an earth reference electrode.

Relay

A relay comprises a transceiver (or receiver) which can receive a signal, and an amplifier which amplifies the signal for the transceiver (or a transmitter) to transmit it onwards.

There may be at least one relay. The at least one relay (and the transceivers or transmitters associated with the apparatus or at the surface) may be operable to transmit a signal for at least 200 m through the well. One or more relays may be configured to transmit for over 300 m, or over 400 m.

For acoustic communication there may be more than five, or more than ten relays, depending on the depth of the well and the position of the apparatus.

Generally, less relays are required for EM communications. For example, there may be only a single relay. Optionally therefore, an EM relay (and the transceivers or transmitters associated with the apparatus or at the surface) may be configured to transmit for over 500 m, or over 1000 m.

The transmission may be more inhibited in some areas of the well, for example when transmitting across a packer. In this case, the relayed signal may travel a shorter distance. However, where a plurality of acoustic relays are provided, preferably at least three are operable to transmit a signal for at least 200 m through the well.

For inductively coupled tubulars, a relay may also be provided, for example every 300-500 m in the well.

The relays may keep at least a proportion of the data for later retrieval in a suitable memory means.

Taking these factors into account, and also the nature of the well, the relays can therefore be spaced apart accordingly in the well.

The control signal may cause, in effect, immediate activation, or may be configured to activate the apparatus after a time delay, and/or if other conditions are present such as a particular pressure change.

Other Apparatus Options

In addition to the control signal, the apparatus may include pre-programmed sequences of actions, for example a valve opening and re-closing, or a change in valve member position; based on parameters for example time, pressure detected or not detected or detection of particular fluid or gas. For example, under certain conditions, the apparatus will perform certain steps sequentially—each subsequent step following automatically. This can be beneficial where a delay to wait for a signal to follow on could mitigate the usefulness of the operation.

The apparatus may have a mechanism to orientate it rotationally. Nozzles can also be provided in order to direct its effects towards the communication paths for example.

Normally the port is provided on a side face of the apparatus although certain embodiments can have the port provided in an end face.

The non-return valve, where present, may resist fluid entry into the container.

Barrier Test

The apparatus may be provided below a barrier (such as certain annular sealing devices described herein) and the well manipulated such that a pressure test carried out therebelow, when fluid is deployed. The increased pressure caused by fluid being deployed into this area, stresses the barrier and so can be used to test the barrier. Indeed, it stresses it in the direction it is intended to withstand positive pressure, and so is a more effective direction of testing, compared with testing it from above.

Thus, for some methods, there need not be communication between the formation and the well. For example a pressure test may be conducted in a closed area in the well, for example between barriers or annular sealing devices, i.e. there being no communication paths in the well between the barriers or two annular sealing devices and the adjacent formation.

For example, a lower barrier bridge or cement plug is typically installed in a well to act as a primary barrier to the reservoir and is exposed, on its lower side, to reservoir pressure. Then a short distance above is a secondary barrier, often another bridge plug or cement plug. Such a secondary barrier can be tested from therebelow in accordance with the procedures set out herein.

This compares to known methods of reducing the hydrostatic head above such a barrier. This known test is time consuming and removes the safety barrier of the hydrostatic head, compromising well control.

The apparatus may hang off the secondary barrier.

The barrier can be set after the apparatus is deployed into the well and charged.

One or more secondary containers, described herein above, may be provided having an underbalance of pressure. This may be used to conduct a negative pressure test on the barriers, or to draw in, at least in part, the volume of fluid added from the primary container after a test which added fluid has been completed.

A discrete temperature array may be deployed in the section between the barriers, or in a ring or helix above or below the barriers to assist in identifying the location of any leak detected.

Charging Means

For certain embodiments including those used for such a barrier test, the apparatus may surprisingly have an in-situ charging means, even though for barrier tests, the pressure surrounding the apparatus is being increased by the apparatus deploying fluids into this area.

The charging means comprises a valve controlling a port. Preferred embodiments have the gas separated from the fluid to be deployed by use of a floating piston in the container. The valve is opened when pressure surrounding the apparatus is higher than the pressure of the gas. It is therefore charged. The charged gas is then sealed in the apparatus by the valve, and can be used when the surrounding well conditions have a lower pressure. The gas then acts on the fluid to be deployed into the surrounding portion of the well to deploy it.

The port may be used both to deploy fluid and charge the gas. Alternatively, separate ports may be provided. Thus, the port may be a first port, and a second port may be provided in the apparatus between the container and a surrounding portion of the well, the first and second ports separated within the apparatus by a floating piston. Where two ports are provided, the valve may be a one-way valve such that when open, it allows pressure and fluid communication from the well into the container, but resists such communication from the container into the well. In a closed position it resists communication in both directions.

For certain embodiments, the gas is compressed even more, by imposing a pressure from or close to the surface of the well (before the barrier is set) so that the charging means allows for greater compression of the gas. The compressed gas is then sealed in by closing the valve.

The pressure of the gas may also be increased by use of well temperature.

Deployment

An annular sealing device may or may not be present in the well.

For certain embodiments, the apparatus may be deployed with an annular sealing device or after an annular sealing device is provided in the well following an earlier operation. In the former case, it may then be provided on the same string as the annular sealing device and deployed into the well therewith. In the latter case, it may be retro-fitted into the well, optionally below, the annular sealing device. In this latter example, it is normally connected to a plug or hanger, and the plug or hanger in turn connected directly or indirectly, for example by tubulars, to the annular sealing device. The plug may be a bridge plug, wireline lock, tubular/drill pipe set barrier, shut-in tool or retainer such as a cement retainer. The plug may be a temporary or permanent plug.

Also, the apparatus may be provided in the well and then an annular sealing device deployed and set thereabove and then the method described herein performed after the annular sealing device is run in.

The container may be sealed at the surface, and then deployed into the well. 'At surface' in this context is typically outside of the well although it could be sealed whilst in a shallow position in the well, such as up to 30 metres from the surface of the well, that is the top of the uppermost casing of the well. Thus the apparatus moves from the surface and is positioned in the well with the container sealed, before moving the valve member. Depending on the particular embodiment and the deployment method, it may be run in a well with no annular sealing device, or with the annular sealing device already thereabove or move past a previously installed annular sealing device.

For certain embodiments, the entire apparatus may be below the annular sealing device, as opposed to a portion of the apparatus.

The port of the apparatus may be provided within 100 m of a communication path between the well and the reservoir, optionally 50 m or 30 m. If there is more than one communication path, then the closest communication path is used to determine the spacing from the port of the apparatus. Optionally therefore, the port in the container may be spaced below communication paths in the well. This can assist in moving debris away from the communication path(s) to help clear them.

In certain embodiments, the apparatus may be run on a tubular string, such as a test, completion, suspension, abandonment, drill, tubing, casing or liner string. Alternatively, the apparatus may also be conveyed into the well on wireline or coiled tubing (or a tractor). The apparatus may be an integral part of the string.

The apparatus is typically connected to a tubular before it is operated. Therefore whilst it may be run in by a variety of means, such as wireline or tubing, it is typically connected to a tubular such as production tubing or casing when in the well, before it is operated. This provides flexibility for various operations on the well.

The connection may be by any suitable means, such as by being threaded, gripped, latched etc. onto the tubular. Thus normally the connection between the tubular takes some of the weight of the apparatus, albeit this would not necessarily happen in horizontal wells.

The apparatus may be provided towards or at the lowermost end of a lowermost casing or liner. The container may be defined, at least in part, by the casing or liner. Therefore the lowermost part of the container may be within 100 m of the bottom of the well and indeed may be the bottom of the casing.

The string may be deployed as part of any suitable well operation, including drilling, well testing, shoot and pull, completion, work-over, suspension and/or abandonment operation.

The string may include perforating guns, particularly tubing conveyed perforating guns. The guns may be wirelessly activatable such as from wireless, especially EM and/or acoustic, signals.

In such a scenario, there may not be straightforward access below guns to the lower zone(s). Thus when run with such a string, embodiments of the invention provide means to manipulate such a zone.

A plurality of apparatus described herein may be run on the same string. For example spaced apart and positioned within one section or isolated sections. Thus, the apparatus may be run in a well with multiple isolated sections adjacent different zones. When the port of the apparatus is isolated from the surface of the well, flow may continue from a separate zone, which is not in pressure communication with the port, and not isolated from the surface of the well.

The apparatus may be dropped off an associated carrying string after the valve member has been opened or for any other reason (for example it is not required and is not possible or useful to return it to surface). Thus it is not always necessary to return it to the surface.

A variety of arrangements of the apparatus in the well may be adopted. The apparatus may be positioned substantially in the centre of the well.

Alternatively the apparatus may be configured as an annular tool to allow well flow through the inner tubular before the well is isolated, after the isolation is removed or from another section, therefore, the container is formed in an annular space between two tubes and the well can flow through the inner tube.

In other embodiments, the apparatus can be offset within the well, for example attached/clamped onto the outside of a pipe or mounted offset within a pipe. Thus it can be configured so apparatus or other objects (or fluid flow) can move through the bore of the pipe without being impeded. For example it may have a diameter of 1¾ inches offset inside a 4" inner diameter outer pipe. In this way, one or more wireline apparatus can still run past it, as can fluid flow.

The apparatus may be run into the well as a permanent apparatus designed to be left in the well, or run into the well as a retrievable apparatus which is designed to be removed from the well.

Clearing and Testing

The method according to the invention may be a method to manipulate the well to clear it of some debris, by for example an acid treatment. This may improve well flow after the isolation from the surface has been removed, and/or be used to clear a portion of the well prior to or after perforating or at other times.

In certain embodiments, the apparatus can be used to create a dynamic overbalance to disrupt, inhibit and/or reverse the settling out and partial solidification of well fluids in parts of the well, especially the annulus.

The apparatus may be used to conduct an interval injectivity test, pressure test, permeability test, hydraulic fracturing or minifrac operation, connectivity tests such as a pulse or interference test, chemical delivery, or well/reservoir treatment such as acid treatment.

A pulse test is where a pressure pulse is induced in a formation at one well/isolated section of the well and detected in another "observing" well or separate isolated section of the same well, and whether and to what extent a pressure wave is detected in the observing well or isolated section, provides useful data regarding the pressure connectivity of the reservoir between the wells/isolated sections. Such information can be useful for a number of reasons, such as to determine the optimum strategy for extracting fluids from the reservoir.

An interference test is similar to a pulse test, though monitors longer term affects at an observation well/isolated section following production (or injection) in a separate well or isolated section.

For such connectivity tests, the well being manipulated according to embodiments of the present invention is the observing well/isolated section. Thus the method described herein may include observing for pressure changes in the well as part of a connectivity test.

For certain embodiments however, the method of manipulating the well may be the well—particularly the isolated section—from where pulses are sent using the apparatus. For example, in a multi-lateral well, the apparatus may send a pressure pulse from one side-track of the same well to another. Side tracks (or the main bore) of wells which are isolated from each other are defined herein as separate isolated sections.

Manipulating may include altering pressure and injecting fluids. The method to manipulate a well can be a method to at least partially clear the well optionally in preparation for a test.

Thus according to a second aspect of the present invention there is provided a method to conduct a procedure or test on a well, comprising:

conducting the method to manipulate the well, as described herein;

conducting a procedure/test on the well, the procedure/test includes one or more of image capture, connectivity tests such as a pulse or interference test, build-up test, drawdown test, a drill stem test (DST), extended well test, (EWT), hydraulic fracturing or minifrac procedure, pressure test, flow test, well/reservoir treatment such as an acid treatment, permeability test, injection procedure, gravel pack operation, perforation operation, string deployment, workover, suspension and abandonment.

The test is normally conducted on the well before removing the apparatus from the well, if it is removed from the well.

Embodiments of said second aspect may improve the pressure or fluid communication across the face of the formation and improve the performance of tests.

The method to conduct a test/procedure on the well may also include perforating the well. However, the method of the present invention may be independent from operation of the guns. The well may be openhole and/or pre-perforated.

Thus the method of the invention can improve the reliability and/or quality of data received from subsequent testing. The apparatus may be used to clear the surrounding area, for example by expelling a clear fluid, before images are captured.

According to a third aspect of the present invention there is provided a method to manipulate a well, comprising:

providing an apparatus in a well, the apparatus comprising:

a container having a volume of at least 10 litres, and containing gas or liquefied gas at a pressure of at least 1000 psi;

a port to allow pressure and fluid communication between a portion of the container and the surrounding portion of the well;

a mechanical valve assembly having a valve member adapted to move, to selectively allow or resist, directly or indirectly, fluid exit from at least a portion of the container, via the port;

a control mechanism to control the mechanical valve assembly, comprising a communication device configured to receive a control signal for moving the valve member;

sending a control signal to the communication device at least in part by a wireless control signal transmitted in at least one of the following forms: electromagnetic (EM), acoustic, inductively coupled tubulars and coded pressure pulsing;

moving the valve member in response to said control signal;

allowing gas from said gas or liquefied gas in the container, to escape from the container to reduce the hydrostatic head in the well.

Thus for embodiments in accordance with the third aspect of the invention, the port of the isolated apparatus is not necessarily isolated from the surface of the well. Nevertheless, more generally, preferred and optional features described above with respect to the earlier aspects of the invention are independently preferred and optional features of the third aspect of the invention, unless stated otherwise, and are not repeated here for brevity. For example, propellant may be used with the embodiments of the third aspect of the invention.

In order to start a well flowing the hydrostatic head needs to be smaller than the well pressure. Coiled tubing is often used and gas circulated to reduce the hydrostatic head accordingly. However it may be possible to reduce the hydrostatic head by filling the tubing with gas without the use of coiled tubing.

Embodiments of the invention can be used to reduce the hydrostatic head by bleeding gas from the container. Moreover, bleeding of the gas can be activated at a pre-determined pressure following activation by the control signal and preferably released in a controlled manner in a controlled time period. The benefits may include a greater reduction in hydrostatic head and/or obviating the need to operate coiled tubing, which is time consuming and expensive.

The fluid from the container is therefore preferably gas (or liquefied gas) though the presence of some liquid may be possible. Thus preferably at least 80 vol % of the fluid is gas (normally at STP) more likely at least 90 vol % or at least 95 vol %. The preferred gas is nitrogen.

Thus certain embodiments in accordance with the third and optionally the other aspects of the invention, may have a gas at high pressure, e.g. over 2,500 psi, 5,000 psi, 10,000 psi which gradually escapes optionally through a choke valve and can release gas into the fluid column to reduce the hydrostatic head to encourage a well to flow especially to start a well flowing. Thus certain embodiments can provide a lifting functionality without the time and expense of running coiled tubing. This may be below an annular sealing device and optional features described above for the annular sealing device and its relationship with the apparatus are optional features according to the third aspect of the invention.

In certain scenarios in a gas well, certain lower communication paths may be restricted from flowing by a liquid sitting across the well, whilst gas is produced from above this liquid. The pressure below the liquid is not sufficient to overcome the hydrostatic head of the liquid and gas thereabove. Accordingly gas flow from said lower communication paths may be stopped Embodiments of the present invention may be used to provide additional lift to overcome the hydrostatic head in such a scenario, and encourage recovery of gas from the lower communication paths.

Propellant

According to a fourth aspect of the present invention, there is provided a method to manipulate a well, comprising:

(a) providing an apparatus comprising:

- a container having a volume of at least 1 litre and at most 1600 litres;
- a port to allow pressure and fluid communication between a portion of the container and the surrounding portion of the well;
- a mechanical valve assembly having a valve member adapted to move to selectively allow or resist, directly or indirectly, fluid exit from at least a portion of the container via the port;
- a control mechanism to control the mechanical valve assembly, comprising a communication device configured to receive a control signal for moving the valve member;

(b) providing a propellant in at least a portion of the container;

(c) activating the propellant to produce a gas at a pressure of at least 1000 psi;

(d) running the apparatus into the well, such that the apparatus is at least 100 m below the surface of the well; then, (e) sending a control signal to the communication device in part by a wireless control signal transmitted in at least one of the following forms: electromagnetic (EM), acoustic, inductively coupled tubulars and coded pressure pulsing; then, (f) moving the valve member in response to said control signal to allow at least a portion of the gas or a liquid to be released from the container;

wherein the container has pressure of at least 100 psi more than a surrounding portion of the well immediately before the valve member is moved in response to the control signal.

The port of the apparatus may be isolated from the surface. The well may be shut in as described in embodiments of the earlier aspects of the invention.

The steps (b) to (f) can be conducted in a variety of orders, as detailed above with respect to the first aspect of the invention.

More generally, preferred and optional features described above with respect to earlier aspects of the invention are independently preferred and optional features of the fourth aspect of the invention, unless stated otherwise, and are not repeated here for brevity.

The propellant may be a low explosive. Suitable propellants are nitro-cellulose based powders.

Miscellaneous

The well may be a subsea well. Wireless communications can be particularly useful in subsea wells because running cables in subsea wells is more difficult compared to land wells. The well may be a deviated or horizontal well, and embodiments of the present invention can be particularly suitable for such wells since they can avoid running wireline, cables or coiled tubing which may be difficult or not possible for such wells.

References herein to perforating guns includes perforating punches or drills, all of which are used to create a flowpath between the formation and the well.

The surrounding portion of the well, is the portion of the well surrounding the port immediately before the valve member is moved in response to the control signal.

When the valve member is in such a position for a sufficient period of time (which may be less than a second), the pressure between the inside of a portion of the container and the surrounding portion of the well may equalise, in the absence of other forces. Nevertheless, for certain embodiments, the valve member may be moved into the first or a further, closed position before the pressure has equalised.

The volume of the container is its fluid capacity.

Transceivers, which have transmitting functionality and receiving functionality; may be used in place of the transmitters and receivers described herein.

Unless indicated otherwise, any references herein to "blocked" or "unblocked" includes partially blocked and partially unblocked.

All pressures herein are absolute pressures unless stated otherwise.

The well is often an at least partially vertical well. Nevertheless, it can be a deviated or horizontal well. References such as "above" and below" when applied to deviated or horizontal wells should be construed as their equivalent in wells with some vertical orientation. For example, "above" is closer to the surface of the well through the well.

A zone is defined herein as formation adjacent to or below the lowermost barrier or annular sealing device, or a portion of the formation adjacent to the well which is isolated in part between barriers or annular sealing devices and which has, or will have, at least one communication path (for example perforation) between the well and the surrounding formation, between the barriers or annular sealing devices. Thus each additional barrier or annular sealing device set in the well defines a separate zone except areas between two barriers or annular sealing devices (for example a double barrier) where there is no communication path to the surrounding formation and none are intended to be formed.

"Kill fluid" is any fluid, sometimes referred to as "kill weight fluid", which is used to provide hydrostatic head typically sufficient to overcome reservoir pressure.

Embodiments of the present invention will now be described, by way of example only, with reference to the accompanying figures in which.

Figure 1:
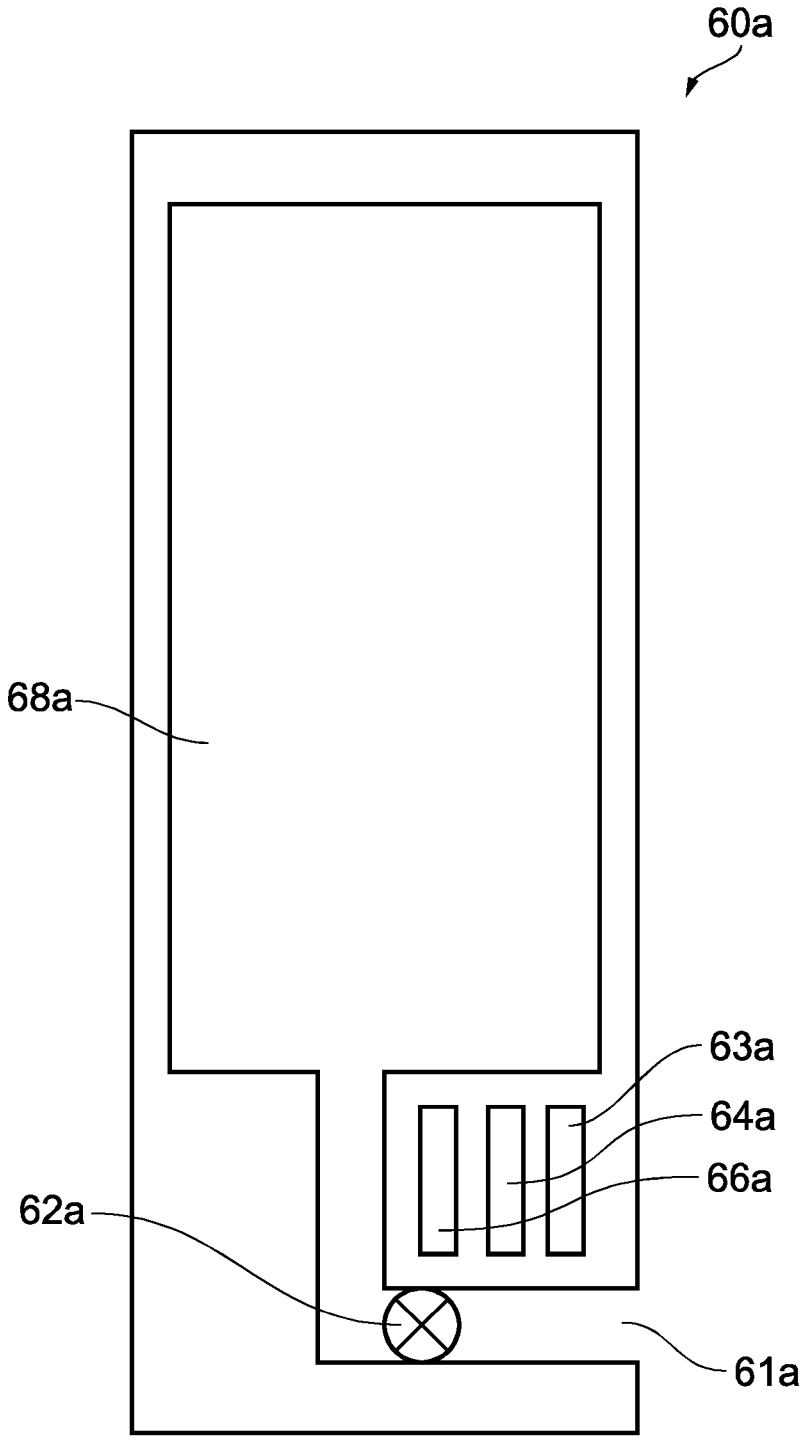
FIG. 1 is a schematic view of a first apparatus which may be used in the method of the present invention.

FIG. 1 shows apparatus 60*a* in accordance with the present invention in the form of a modified pipe, comprising a side opening 61*a*, a valve 62*a*, a control mechanism comprising a valve controller 66*a* and wireless transceiver (or receiver) 64*a*, a battery 63*a* and a container 68*a*. In use there is an overbalance of pressure between the container 68*a* and a surrounding portion of a well.

The battery 63*a* serves to power the apparatus 60*a* after it has been run into the well.

The valve 62*a* is configured to isolate the opening 61*a* to seal the container 68*a* from the surrounding portion of the well in a closed position and allow pressure and fluid communication between a portion of the container 68*a* and the surrounding portion of the well via the opening 61*a* in an open position.

The components of the control mechanism (the transceiver 64*a* and the valve controller 66*a* which controls the valve 62*a*) are normally provided adjacent each other, or close together as shown; but may be spaced apart.

In some embodiments, the container 68*a* is filled with a gas, such as nitrogen. In such embodiments, the gas is sealed in the container at the surface before being run into the well.

In an alternative, the apparatus 60*a* may be used to reduce the hydrostatic head of a fluid column in a well, in order to assist in starting fluid flow from the well. The valve 62*a* is opened and the gas allowed to escape at an appropriate rate, which reduces the hydrostatic head. Such embodiments can obviate the requirement to run coiled tubing. For example, in certain circumstances such a method can help start a production well.

Figure 2:
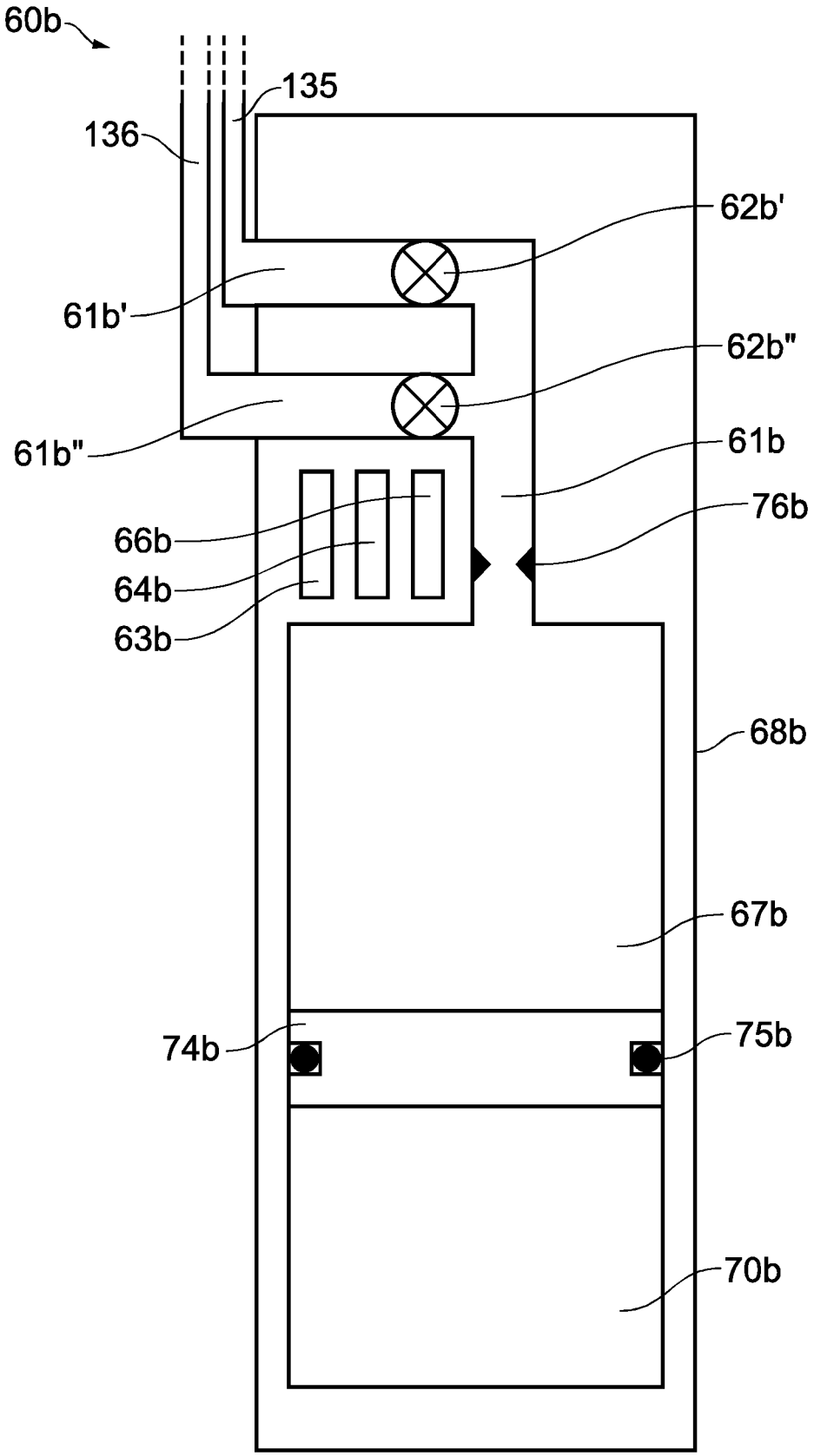
FIG. 2 is a schematic view of a second apparatus including a floating piston which may be used in the method of the present invention.

FIG. 2 shows an embodiment of the apparatus 60*b*. FIG. 2 shows the apparatus 60*b* comprising an opening 61*b*, a choke 76*b*, a container 68*b* with a drive chamber section 70*b*; and a floating piston 74*b* which separates a main fluid-release section 67*b* of the container 68*b* from the drive chamber section 70*b*.

The opening 61*b* branches into two different lines 61*b*' & 61*b*" controlled by valves 62*b*' and 62*b*" respectively. Each line 61*b*' & 61*b*" connects to a separate outlet tube 135, 136.

Depending on the position of valve members (not shown) of the valves 62*b*' & 62*b*", pressure and fluid communication between a portion of the container 68*b* and a surrounding portion of a well is selectively allowed. The valves 62*b*' & 62*b*" are configured to isolate the lines 61*b*' & 61*b*" of the opening 61*b* to seal the container 68*b* from the surrounding portion of the well in a closed position, and allow pressure and fluid communication between a portion of the container 68*b* and the surrounding portion of the well via the opening 61*b* in an open position.

The valves 62*b*' & 62*b*" are controlled by a valve controller 66*b*. The apparatus 60*b* also includes a communication device in the form of a transceiver 64*b* coupled to the valve controller 66*b* which is configured to receive a wireless control signal. In use, the valves 62*b*' & 62*b*" are moved from the closed position to the open position in response to the control signal.

The apparatus 60*b* also comprises a battery 63*b* to power electronics such as the transceiver 164*ba* and valve controller 66*b*. Separate batteries may be provided for each powered component.

The floating piston 74*b* comprises an annular seal 75*b* located around the floating piston 74*b* and in contact with an inner surface of the container 68*b*.

The present embodiment is designed to expel the contents of the fluid-release section 67*b* of the container 68*b* into the well due to an overbalance of pressure in the container 68*b*; compared to the well. The drive chamber 70*b* comprises a gas (filled through a fill port, not shown), which is allowed to expand when pressure is dropped—caused by opening of the valves 62*b*' and/or 62*b*"- and so drives the floating piston 74*b* towards the opening 61*b* to expel at least some of the contents of the fluid-release section 67*b* of the container 68*b*.

A signal is sent to the valve controller 66*b* instructing the valves 62*b*' and/or 62*b*" to open. Once one or both of the valves 62*b*' & 62*b*" are open, the gas in the drive chamber 70*b* can expand. This expansion forces the floating piston 74*b* to move in an upwards direction, thus forcing the liquid in the fluid-release section 67*b* of the container 68*b* upwards towards the choke 76*b*. The liquid in the fluid-release section 67*b* is then forced out of the opening 61*b* at a rate controlled by the cross-sectional area of the choke 76*b*. For certain embodiments, the choke 76*b* and the valves 62*b*' & 62*b*" may be combined to create a variable choke. Also, the valves 62*b*' & 62*b*" may be opened and closed multiple times to release the contents over a period of time.

The fluid-release section 67*b* of the container 68*b* is filled with a liquid, such as hydrochloric acid, so that an acid treatment, sometimes called an "acid wash" can be conducted to clean or treat the inner surface of the well. In some embodiments, the choke 76*b* may be integral with the valves 62*b*' and/or 62*b*".

Figure 3:
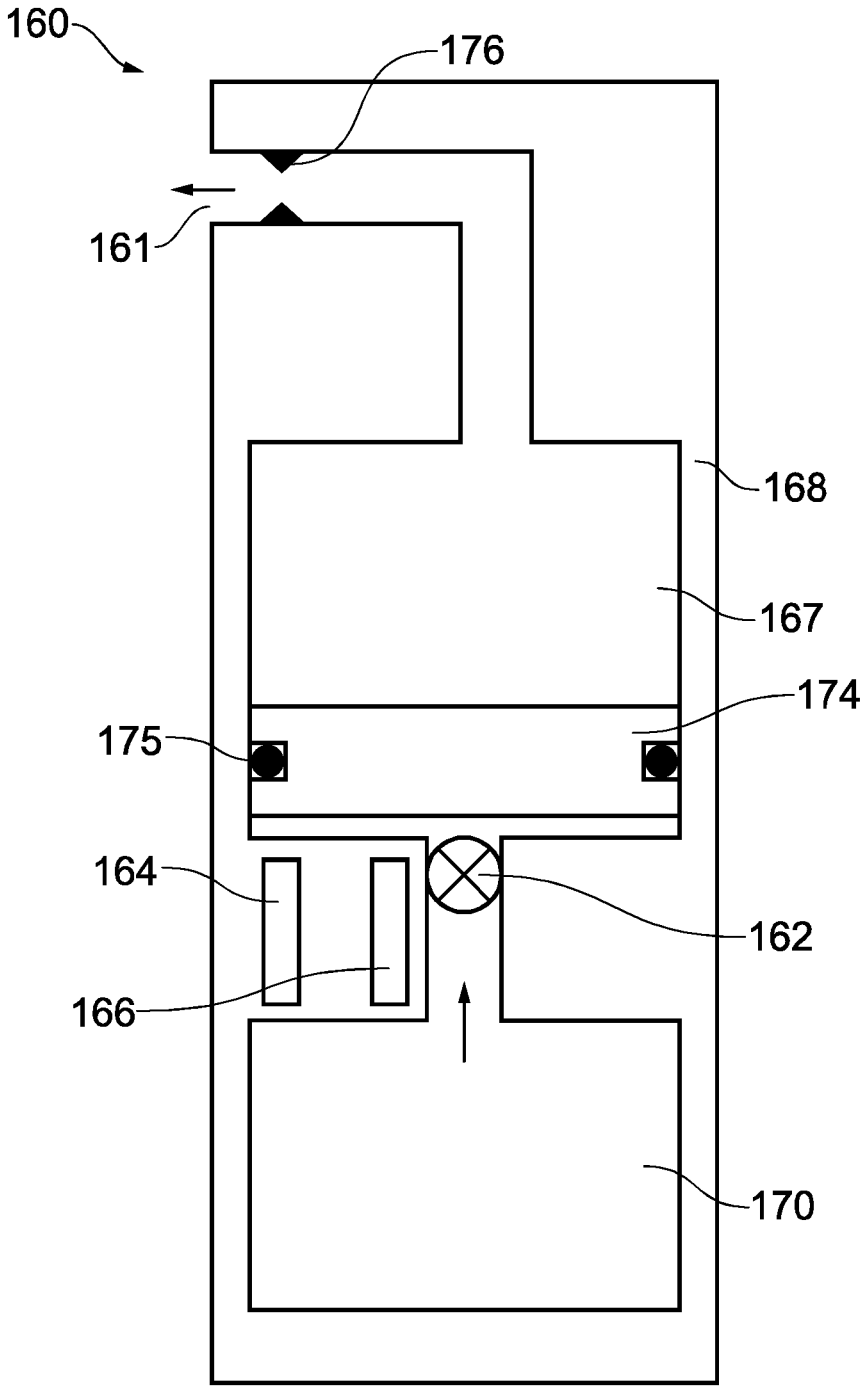
FIG. 3 is a schematic view of a third apparatus including a drive chamber which may be used in the method of the present invention.

FIG. 3 shows a further embodiment of the apparatus 160. The apparatus 160 includes many common features of the earlier embodiments. But in contrast to the embodiments shown in FIGS. 1 and 2, FIG. 3 shows apparatus 160 wherein a control valve 162 is located in a central portion of the apparatus between a fluid-release section 167 and a drive chamber 170 both of the container 168. The present embodiment is designed to expel fluids from the fluid-release section 167 into a well via a mechanical control valve 162 which indirectly allows or resists fluid exit from the port 161 due to an overbalance of pressure in the drive chamber 170.

The floating piston 174 is located in the fluid-release section 167 of the container 168 above the control valve 162. The drive chamber 170 is pressurised so that its pressure is higher than the surrounding portion of the well.

A further check valve (not shown) may be provided close to the choke 176 to prevent fluids from mixing with well fluids. However even without such a check valve, the piston doesn't move with the control valve 162 closed and so little mixing occurs.

In use, the sequence begins with the control valve 162 in the closed position and the floating piston 174 located towards the bottom (as illustrated) of the container 168. A signal is then sent to the valve controller 166 instructing the control valve 162 to open. Once the control valve 162 opens, the overbalance of pressure in the drive chamber 170, drives the piston 174 upwards and expels fluid in the fluid-release section 167 of the container to the surrounding portion of the well. The rate at which the fluid in the fluid-release section 167 is expelled into the well is controlled by the choke 176.

Figure 4:
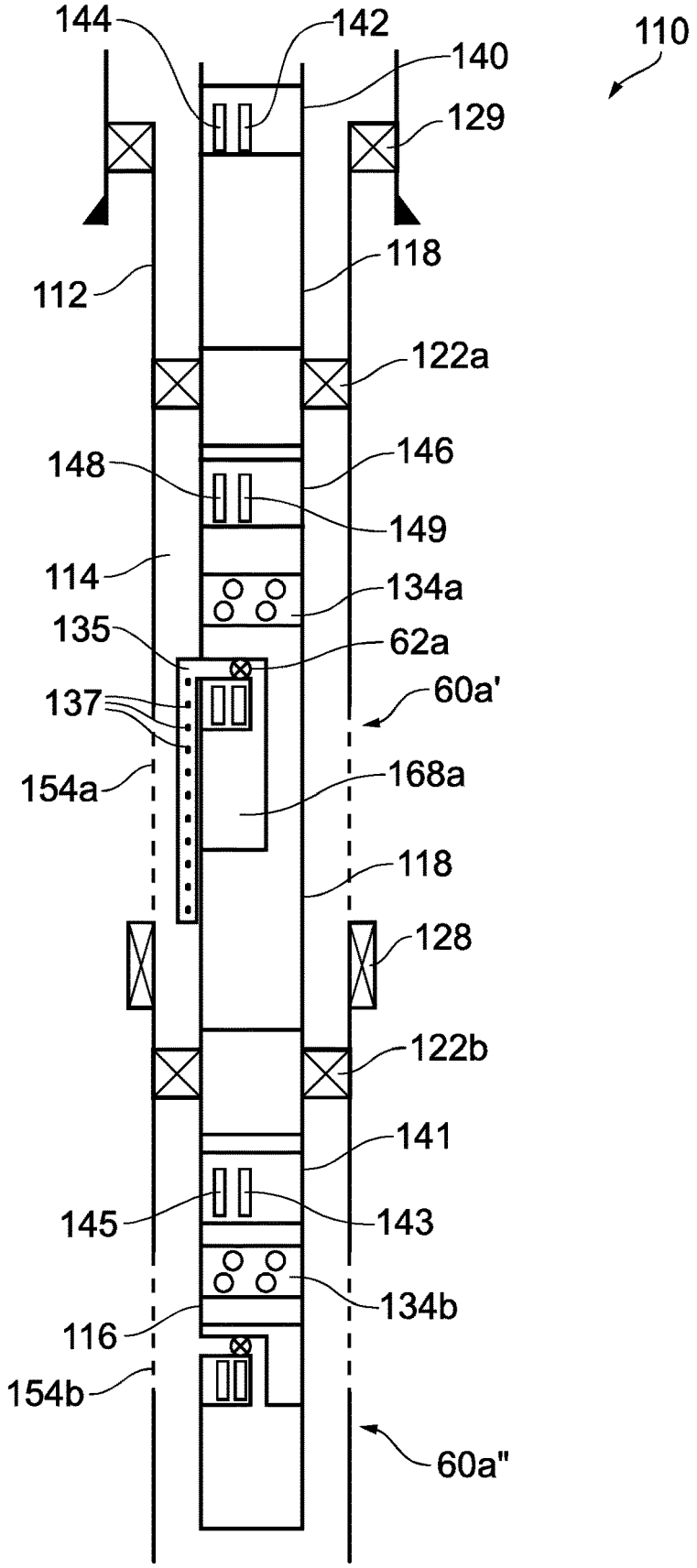
FIG. 4 is a schematic view of a well with multiple zones, illustrating one aspect of the present invention.

FIG. 4 shows a multi-zone well 114 comprising a liner hanger 129 and a liner 112 and two sets of apparatus labelled 60*a*' and 60*a*" in separate sections. These can be the apparatus 60*a* described above or indeed the other embodiments 60*b* or 160 also described above.

Instrument carriers 140, 141 and 146 are provided in each section and also above an annular sealing device in the form of a packer element 122*a*. Each instrument carrier comprises a pressure sensor 142, 143, and 148 respectively, and a wireless relay 144, 145, and 149 respectively. Data from the pressure sensor(s) can be wirelessly transmitted to the surface, for example by acoustic or electromagnetic signals, for monitoring purposes.

Pressure gauges can monitor the pressure within the containers. Moreover, the gauges or other devices can be powered by batteries.

The apparatus 60*a*' also includes an outlet tube 135, which has multiple openings or outlets 137 through which fluid can be released onto an adjacent upper slotted liner 154*a*.

The outlet tube 135 and openings 137 can direct fluid from the container at multiple points, and controlled by the valve 62*a* as shown. A number of other options are available—this tube can be used in the lower section instead of, or in addition to, its illustrated position, and separate valves may be used to control fluid through the openings 137.

The well 114 has its own well apparatus 110 which comprises two annular sealing devices in the form of two packer elements 122*a* & 122*b* which splits the well into a plurality of sections. A first, upper, section comprises the upper packer element 122*a*, a wirelessly controlled upper sleeve valve 134*a*, the upper apparatus 60*a*' and the upper slotted liner 154*a*. The sleeve valve 134*a*, together with the packer 122*a* are the isolating components which isolate the port of the apparatus 60*a*' from the surface of the well.

A second, lower, section comprises the lower packer element 122*b*, a wirelessly controlled lower sleeve valve 134*b*, the lower apparatus 60*a*" and a lower slotted liner 154*b*. For this second section, the sleeve valve 134*b*, together with the packer 122*b* are the isolating components which isolate the port of the apparatus 60*a*" from the surface of the well. Moreover, they also function as lower isolating components for the first upper section.

The slotted liners 154*a*, 154*b* create communication paths between the inside of the liner 112 and the adjacent formation.

Isolating the sections from each other provides useful functionality for manipulating each adjacent zone individually though this is not an essential feature of the invention. For example, the valve 134*a* in the upper section can be closed to isolate the upper apparatus 60*a*' from surface of the well, whilst flow continues from the zone adjacent the second lower section.

The well 114 further comprises a packer such as a swell packer 128 between an outer surface of the liner 112 and a surrounding portion of the formation. An upper tubular 118 and lower tubular 116 are continuous and connected to the liner 112 via the upper packer element 122*a* and the lower packer element 122*b*. Portions of the upper tubular 118 and lower tubular 116 thus serve as connectors to connect the upper apparatus 60*a*' and lower apparatus 60*a*" to the packer elements 122*a*, 122*b* respectively.

In use, the well 114 flows through the lower slotted liner 154*b* and into the lower tubular 116 via the lower sleeve valve 134*b*. The flow continues through the lower tubular 116 past the lower packer element 122*b*, the upper apparatus 60*a*' and instrument carrier 146 before continuing through the upper tubular 118 towards the surface. The upper apparatus 60*a*' (in contrast to the lower apparatus 60*a*") does not take up the full bore of the upper tubular 118 and so fluid can flow therepast from below without being diverted outside of the upper tubular 118.

From an upper zone, the well flows through the slotted liner 154*a* and into the upper tubular 118 via the sleeve valve 134*a*. The flow continues through the upper tubular 118, past the upper packer element 122*a* towards the surface.

In use, the flow may be from the upper zone adjacent the well 114 only, the lower zone adjacent the well 114 only, or may be co-mingled, that is produced from the two zones simultaneously. For example, fluids from the slotted liner 154*b* combine with further fluids entering the well 114 via the upper slotted liner 154*a* to form a co-mingled flow.

The apparatus 60*a*'/60*a*" is activated when the port of the respective apparatus is isolated from the surface by the respective sleeve valves 134*a*/134*b*, which may be prior to flowing the well or after flowing the well. A wireless signal is sent from a controller (not shown) to the valve controller via the transceiver and the valve member opens to allow pressure and fluid communication with the surrounding portion of the well. The overbalance of pressure in the container 168*a* causes the fluid to be released.

The apparatus 60*a*' is particularly suited to deploying acid for an acid treatment, as it can distribute the fluid over the slotted liner 154*a* via the tube 135. The acid can be deployed from the apparatus 60*a*' to function as an acid wash and then optionally pressure in the well can be increased by conventional means to "inject" the acid into the formation.

The apparatus 60*a*" can also be used for chemical discharge for example.

Figure 5:
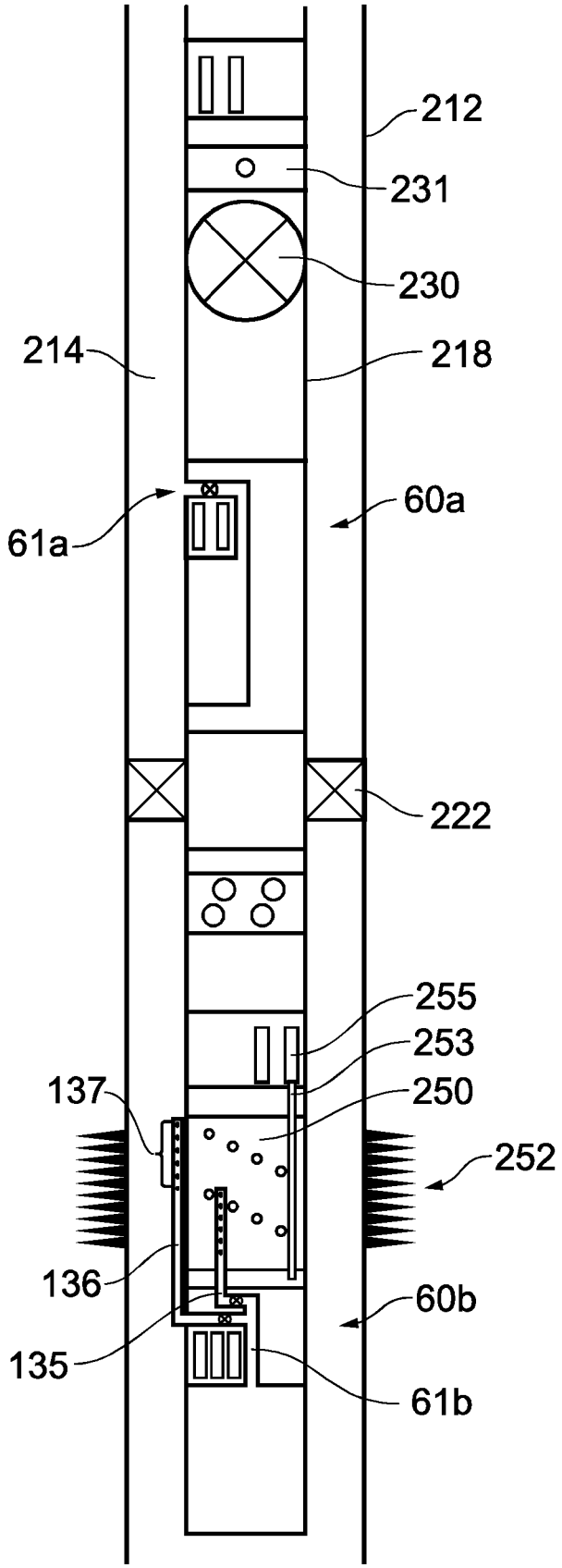
FIG. 5 is a schematic view of a further well illustrating further aspects of the present invention.

FIG. 5 illustrates another method of the present invention used during a drill stem testing (DST) operation. Where the features are the same as the FIG. 4 embodiment they have been labelled with the same number except preceded by a "2". These features will not be described in detail again here. Apparatus 60*a* is located above the packer 222 and includes some propellant (not shown), and apparatus 60*b* is located below the packer 222. Apparatuses 60*a* and 60*b* were previously described in FIG. 1 and FIG. 2. Alternatively the apparatus 160 can be used in place of the apparatus 60*a* and/or 60*b*.

In use, the annulus 214 between the tubing 218 and the casing 212 above the packer 222 includes well fluids which may be relatively dense fluid or mud especially for high pressure wells. The present inventors have noted that under certain circumstances, the mud may become particularly dense and indeed partially solidify, close to the packer 222, for example as the heavier components settle due to gravity or other forces. The transmission of pressure signals close to or through this substance is more difficult—signals may only be received intermittently or not at all. For example, transmission of signals to a tester 230 or circulation 231 valve can be inhibited.

The apparatus 60*a* therefore functions to cause a dynamic overbalance to disrupt, inhibit and/or reverse the settling out and partial solidification of well fluids in the annulus. Signals to the tester valve 230 or circulation valve 231 above the apparatus 60*a* are thereafter more reliable.

A variety of alternatives can be provided. The valve may be cycled so that the overbalanced chamber creates a number of dynamic overbalances spaced apart in time. Further containers or indeed apparatus may also be used for the same purpose.

The apparatus 60*b* is provided below a perforating gun 250. Two outlet tubes 135, 136 extend from opening 61*b* of the apparatus 60*b* over the perforating gun 250. The tubes 135, 136 can have multiple outlets 137 as shown, or alternatively a single outlet, for example to deploy a deploying fluid. The tubing 218 and perforating gun 250 serve as a connector to connect the apparatus 60*b* to the annular sealing device 222.

A discrete temperature array 253 is provided adjacent to the perforations 252 and connected to a controller 255. In this embodiment the discrete temperature array has multiple discrete temperature sensors along the length of a small diameter tube.

After being isolated from the surface of the well by the tester valve 230, the apparatus 60*b* is activated wirelessly by the valves 62*b*' and/or 62*b*" opening, creating a dynamic overbalance, which can direct fluid, such as acid, onto the perforations. Providing two outlets and respective tubes 135, 136 allows fluids to be directed onto the area of the perforations which is assessed as requiring treatment.

The apparatus 60*a*', 60*a*", 60*a*, 60*b* illustrated in FIGS. 4 and 5 can be used independent of each other in single or multiple zone wells.

Various embodiments of the apparatus are interchangeable. For example the apparatus 60*a* can be used in place of the apparatus 60*b* to deploy chemicals.

Figure 6:
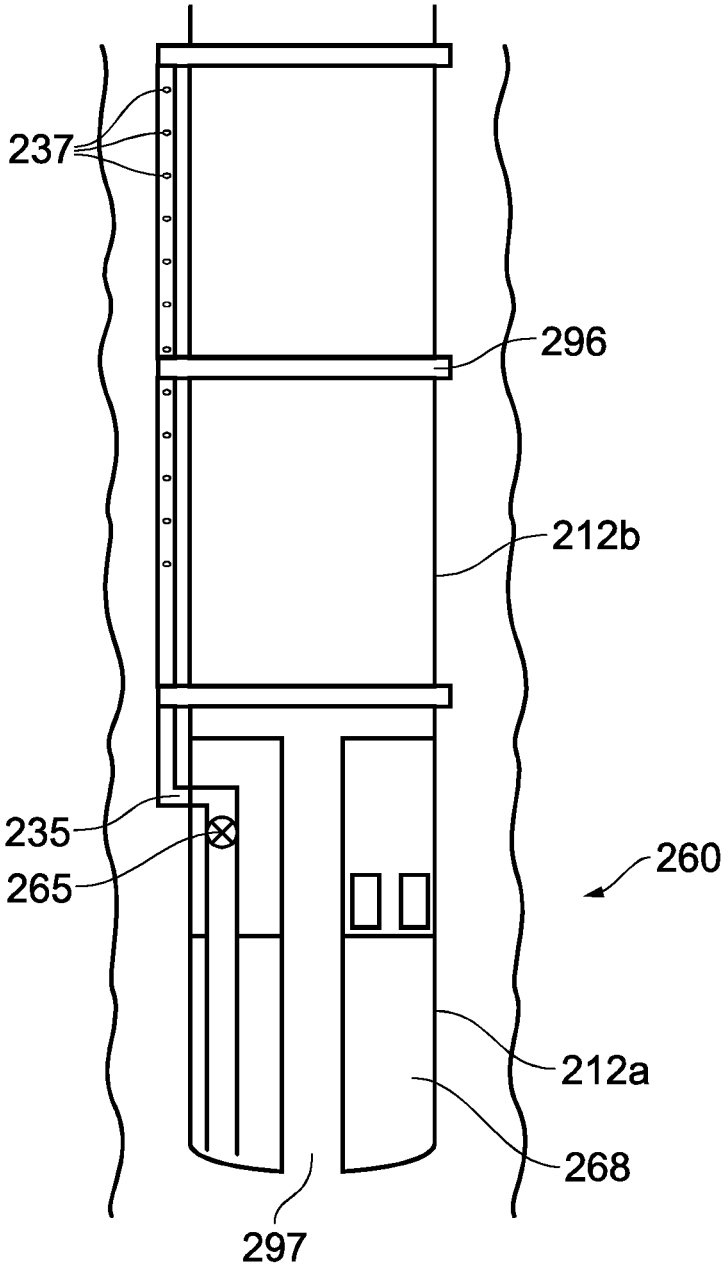
FIG. 6 is a schematic view of a further well showing a further embodiment of the present invention where a portion of casing forms a container.

In FIG. 6, an alternative embodiment of an apparatus 260 with a container 268 is illustrated. Common features, for example a valve (labelled 265 in FIG. 6), with earlier embodiments are not described again in detail for brevity. In contrast to earlier figures the container 268 is in part defined by the surrounding casing 212*a* and outlet tube 235 with openings 237 is secured to a portion of the casing 212*b* above the container 268 by clamps 296. Such an apparatus 260 is normally run on the casing, slotted liner or screens 212*a*/212*b* when completing the well. An advantage of such an embodiment is that the container can have larger volumes without running further tubing into the well. The apparatus 260 may have flow bypass 297 for cementing during completion or for circulating during deployment. Whilst applicable more generally, such embodiments are useful for deploying treatments or artificial gas lift in accordance with the third aspect of the present invention to a toe of a deviated well.

Moreover, embodiments can be used to clear water from a gas well. In such embodiments, the outlet tube 235 would not be required and the gas is ported to the casing above the container (rather than the annulus between the casing and the well). In certain situations, a gas well produces from an upper zone or section of a zone and a water column resists gas production from a lower zone which has insufficient pressure to overcome the combined hydrostatic head of the water column and upper zone. The water column is thus 'trapped' in the well and prevents production from a lower zone. Certain embodiments of the present invention, such as the FIG. 6 embodiment, can be used to remove a portion of the water column to allow the lower zone to produce.

More generally, embodiments of the present invention in accordance with the third aspect of the invention can function in a gas lift application, for example to assist in commencing flow from the lower end of a highly permeable well.

Figure 7:
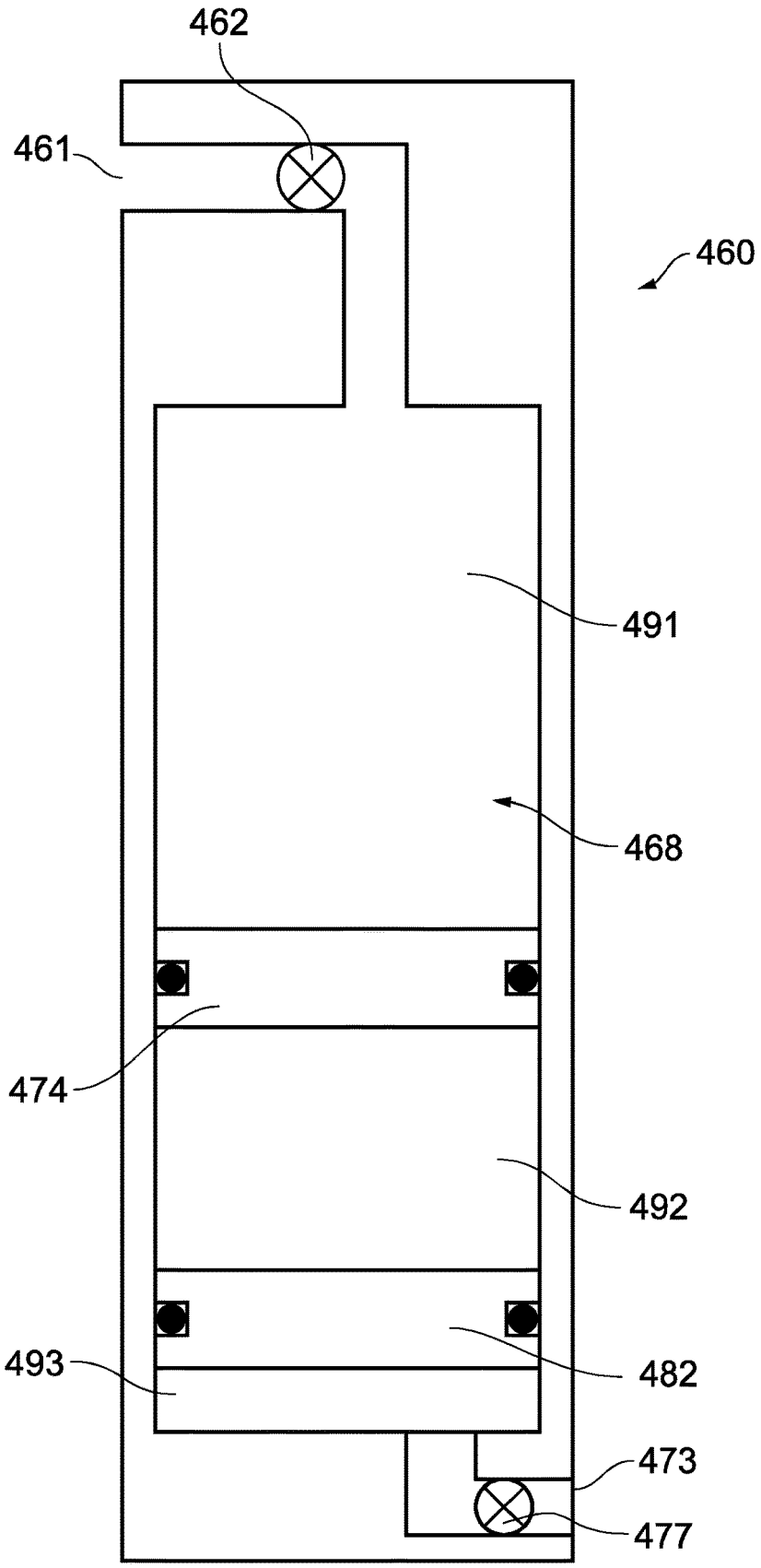
FIG. 7 is an alternative apparatus having a charging means for use with embodiments of the present invention; and, FIG. 8 is a front view of an embodiment of a valve assembly for use with the various apparatus whilst conducting the method in accordance with the present invention.

An alternative apparatus providing a similar charging option is an apparatus 460 shown in FIG. 7. Like parts with earlier embodiments are not described in detail but are prefixed with a '4'.

The apparatus 460 comprises a container 468, a first valve 462 in a first port 461, and a second valve 477 in a second port 473 at an opposite end to the first port 461. The container 468 has a first floating piston 474 separating a first liquid containing section 491 from a second gas containing section 492. A second floating piston 482 is provided in the container 468 between the second port 473 and the first floating piston 474, to define a third 'charging' section 493.

In use, the apparatus 460 may be launched with the floating piston 474 positioned such that around three quarters of the container 468 is the gas containing section 492 and around one quarter is the liquid containing section. As the apparatus is moved deeper into the well, the increased well pressure will cause movement of the floating piston 474 and compress the gas.

The apparatus is positioned below the barrier to be tested, with the valve 477 open and well fluids are received into the charging section 493 of the container 468 compressing or 'charging' the gas in the second section 492 to the surrounding well pressure. The valve 477 is then closed.

When the barrier (not shown) is in place, and the pressure surrounding the apparatus reduced (for example less pressure from surface) the valve 462 is opened to allow the fluid from the first section 491 of the container 468 into the surrounding portion of the well driven by the compressed gas in the second section 492 of the apparatus 460. Thus using the FIG. 7 apparatus the charging functionality is provided and also the fluid being expelled can be chosen for its intended use, such as an acid treatment.

The embodiments as described may make use of any additional pressure in the well in order to charge the gas further. For example if a certain operation was occurring in the well resulting in a higher surrounding well pressure, the valve may be opened to allow the well pressure (when higher) to act on the floating piston and compress the gas in the section before closing the valve. At a later time when the surrounding pressure is less (which may be a consequence of temperature changes), this compressed gas can be used to expel the fluid from the container. This may be useful for pressure testing a barrier which is formed after the apparatus is charged from below since the nature of fluids expelled is not important.

Figure 8:
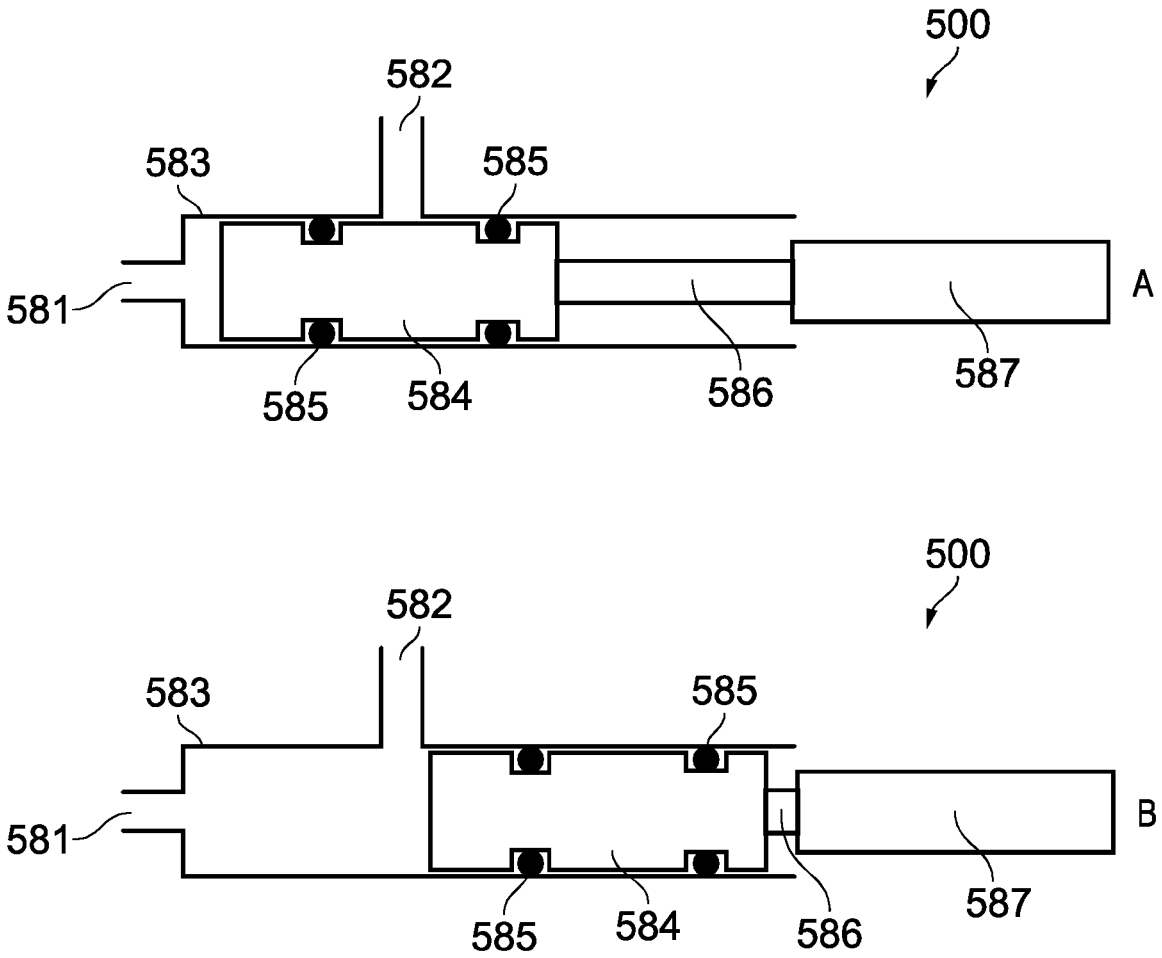

A variety of valves may be used with the apparatus described herein. FIG. 8 shows one example of a valve assembly 500 in a closed position A and in an open position B. The valve assembly 500 comprises a housing 583, a first inlet port 581, a second outlet port 582 and a valve member in the form of a piston 584. The valve assembly further comprises an actuator mechanism which comprises a lead screw 586 and a motor 587.

The first port 581 is on a first side of the housing 583 and the second port 582 is on a second side of the housing 583, such that the first port 581 is at 90 degrees to the second port 582.

The piston 584 is contained within the housing 583. Seals 585 are provided between the piston 584 and an inner wall of the housing 583 to isolate the first port 581 from the second port 582 when the valve assembly 500 is in the closed position A; and also to isolate the ports 581, 582 from the actuator mechanism 586, 587 when the valve assembly is in the closed A and/or open B position.

The piston 584 has a threaded bore on the side nearest the motor 587 which extends substantially into the piston 584, but does not extend all the way through the piston 584. The lead screw 586 is inserted into the threaded bore in the piston 584. The lead screw 586 extends partially into the piston 584 when the valve assembly 500 is in the closed position A. The lead screw 586 extends substantially into the piston 584 when the valve assembly is in the open position B.

In use, the valve assembly is initially in the closed position A. A side of the piston 584 is adjacent to the first port 581 and a top side of the piston 584 is adjacent to the second port 582 so that the first port 581 is isolated from the second port 582. This prevents fluid flow between the first port 581 and the second port 582. Once the actuator mechanism receives a signal instructing it to open the valve, the motor begins to turn the lead screw 586 which in turn moves the piston 584 towards the motor 587. As the piston 584 moves, the lead screw 586 is inserted further into the piston 584 until one side of the piston 584 is adjacent to the motor 587. In this position, the first port 581 and the second port 582 are open and fluid can flow in through the first port 581 and out through the second port 582.

Modifications and improvements can be incorporated herein without departing from the scope of the invention. For example various arrangements of the container and electronics may be used, such as electronics provided in the apparatus below the container.

Moreover, whilst the chokes illustrated here are purely reduced diameter chokes, other forms of chokes can be utilised, for example an extended section with a restricted diameter.

The invention claimed is:

1. A method to deploy fluid in a well, comprising:

(a) providing an apparatus comprising:

a container having a volume of at least 1 litre (l) and at most 1600 l;

a port to allow pressure and fluid communication between a portion of the container and a surrounding portion of the well;

a mechanical valve assembly having a valve member adapted to move and one of to selectively allow and to selectively resist, directly or indirectly, fluid exit from at least a portion of the container, via the port;

a control mechanism to control the mechanical valve assembly, comprising a communication device configured to receive a control signal for moving the valve member;

(b) providing a fluid comprising a gas in at least a portion of the container, said portion having a volume of at least 1 l;

(c) pressurising the gas to a pressure of at least 1000 psi and maintaining it at said pressure for at least one minute;

(d) running the apparatus into the well, such that the apparatus is at least 100 m below the surface of the well; then, (e) isolating the port of apparatus from the surface of the well using at least one isolating component, the, or the uppermost, isolating component being at least 100 m from the surface well;

(f) sending a control signal to the communication device at least in part by a wireless control signal transmitted in at least one of the following forms: electromagnetic (EM), acoustic, inductively coupled tubulars and coded pressure pulsing; then, (g) moving the valve member in response to said control signal to allow at least a portion of the fluid to be released from the container;

and wherein (h) the container has a pressure of at least 100 psi more than a surrounding portion of the well immediately before the valve member is moved in response to the control signal and wherein the fluid is released from the container due to the pressure in the container being higher than the surrounding portion of the well immediately before the valve member is moved in response to the control signal.

2. A method as claimed in claim 1, wherein the fluid released displaces at least 1 l, optionally at least 5 l or at least 10 l of well fluid.

3. A method as claimed in claim 1, wherein step (b) is performed within 20 m of the surface of the well, and step (b) is performed before step (d) and so the apparatus is run into the well with the container having said fluid comprising a gas.

4. A method as claimed in claim 1, wherein the container has a floating piston, and on one side of the floating piston the gas is provided, and on an opposite side of the floating piston a liquid is provided, and the port is in communication with the side of the piston having the liquid.

5. A method as claimed in claim 1, wherein the apparatus is provided in the well below an annular sealing device, the annular sealing device engaging with an inner face of one of a casing and a wellbore in the well, and being at least 100 m below a surface of the well, and a connection means is provided connecting the apparatus to the annular sealing device, the connection means being above the apparatus and below the annular sealing device.

6. A method as claimed in claim 5, wherein the control signal is sent from above the annular sealing device.

7. A method as claimed in claim 5, wherein the port of the apparatus is provided above a second annular sealing device.

8. A method as claimed in claim 7, including conducting a short interval test and wherein the annular sealing device and second annular sealing device are less than 30 m apart, or less than 10 m apart, optionally less than 5 m apart, more optionally less than 2 m, or less than 1 m, or less than 0.5 m apart.

9. A method as claimed in claim 5, wherein the apparatus is deployed into the well in the same operation as deploying the annular sealing device into the well.

10. A method as claimed in claim 1, wherein in step (d) the apparatus is conveyed on one of tubing, drill pipe and casing/liner.

11. A method as claimed in claim 1, wherein a pressure sensor is provided in the well and is coupled to a wireless transmitter and pressure data is transmitted from the wireless transmitter.

12. A method as claimed in claim 1, wherein at least a section of the well containing the port of the apparatus is shut in, at one of surface and downhole, after the apparatus has been run and before the valve member moves in response to the control signal.

13. A method as claimed in claim 1, including using the apparatus to conduct at least one of an interval injectivity test, permeability test, pressure test, a connectivity test such as one of a pulse and interference test, hydraulic fracturing/minifrac procedure, image capture, chemical delivery, and well/reservoir treatment such as acid treatment.

14. A method as claimed in claim 13, wherein the apparatus delivers at least one of a breaker fluid, an acid and one of a chemical barrier and precursors to a chemical barrier, to the well.

15. A method as claimed in claim 1, further comprising conducting a procedure on the well, wherein the procedure includes at least one of image capture, a connectivity test such as one of a pulse and interference test, a build-up test, a drawdown test, a drill stem test (DST), an extended well test (EWT), one of hydraulic fracturing and minifrac procedure, a pressure test, a flow test, well/reservoir treatment such as an acid treatment, a permeability test, an injection procedure, gravel pack operation, perforation operation, string deployment, workover, suspension and abandonment.

16. A method as claimed in claim 1, wherein a pressure test is conducted on a barrier by the apparatus being provided below the barrier, the valve member being moved in response to the control signal causing the fluid to be released from the container to increase pressure below the barrier, and the pressure below the barrier is then monitored.

17. A method as claimed in claim 1, further comprising a charging means having a valve on the or another port, the method including exposing the gas to well pressure via said port to compress the gas, closing said port with said valve to resist fluid and pressure communication from the well into the container, using the compressed gas to facilitate said release of fluid from the container.

18. A method as claimed in claim 1, wherein the apparatus comprises a choke, optionally one of fixed and adjustable.

19. A method as claimed in claim 1, wherein the wireless control signal is transmitted as at least one of electromagnetic and acoustic control signals.

20. A method as claimed in claim 1, wherein the container comprises a propellant which is activated to create gas.

21. A method to deploy fluid in well, comprising:

(a) providing an apparatus comprising:

a container having a volume of at least 1 l and at most 1600 l;

a port to allow pressure and fluid communication between a portion of the container and the surrounding portion of the well;

a mechanical valve assembly having a valve member adapted to move and one of to selectively allow and to selectively resist fluid exit from at least a portion of the container via the port;

a control mechanism to control the mechanical valve assembly, comprising a communication device configured to receive a control signal for moving the valve member;

(b) providing a propellant in at least a portion of the container;

(c) activating the propellant to produce a gas at a pressure of at least 1000 psi;

(d) running the apparatus into the well, such that the apparatus is at least 100 m below the surface of the well; then, (e) sending a control signal to the communication device at least in part by a wireless signal transmitted in at least one of the following forms: electromagnetic (EM), acoustic, inductively coupled tubulars and coded pressure pulsing; then, (f) moving the valve member in response to said control signal to allow at least a portion of one of the gas and a liquid to be released from the container, wherein said portion of one of the gas and liquid is released from the container due to the pressure in the container being higher than the surrounding portion of the well immediately before the valve member is moved in response to the control signal to conduct at least one of an interval injectivity test, permeability test, pressure test, a connectivity test such as one of a pulse and interference test, chemical delivery, and well/reservoir treatment such as acid treatment; and wherein the container has pressure of at least 100 psi more than a surrounding portion of the well immediately before the valve member is moved in response to the control signal.

22. A method as claimed in claim 21, wherein the apparatus is provided in the well below an annular sealing device, the annular sealing device engaging with an inner face of one of a casing and a wellbore in the well, and being at least 100 m below a surface of the well, and a connection means is provided connecting the apparatus to the annular sealing device, the connection means being above the apparatus and below the annular sealing device.

23. A method as claimed in claim 21, wherein the apparatus is conveyed on one of tubing, drill pipe and casing/liner.

24. A method as claimed in claim 21, wherein the well is shut in, at one of surface and downhole, after the apparatus has been run and before the valve member moves in response to the control signal.

25. A method to deploy fluid in a well, comprising:

providing an apparatus in the well, the apparatus comprising:

a container having a volume of at least 10 l, and containing at least one of gas and liquefied gas at a pressure of at least 1000 psi;

a port to allow pressure and fluid communication between a portion of the container and the surrounding portion of the well;

a mechanical valve assembly having a valve member adapted to move, and one of to selectively allow and selectively resist, directly or indirectly, fluid exit from at least a portion of the container, via the port;

a control mechanism to control the mechanical valve assembly, comprising a communication device configured to receive a control signal for moving the valve member;

sending a control signal to the communication device at least in part by a wireless control signal in at least one of the following forms: electromagnetic (EM), acoustic, inductively coupled tubulars and coded pressure pulsing;

moving the valve member in response to said control signal;

allowing gas from said at least one of gas and liquefied gas in the container, to escape from the container to reduce the hydrostatic head in the well; and wherein the gas escapes from the container due to the pressure in the container being higher than the surrounding portion of the well immediately before the valve member is moved in response to the control signal.

* * * * *